US008565443B2

(12) United States Patent
Wurm

(10) Patent No.: US 8,565,443 B2
(45) **Date of Patent: *Oct. 22, 2013**

(54) ADAPTIVE NOISE CONTROL SYSTEM

(75) Inventor: Michael Wurm, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 760 days.

This patent is subject to a terminal disclaimer.

(21) Appl. No.: 12/483,661

(22) Filed: Jun. 12, 2009

(65) Prior Publication Data

US 2010/0014685 A1 Jan. 21, 2010

(30) Foreign Application Priority Data

Jun. 13, 2008 (EP) ..... 08010843

(51) Int. Cl.
*H03B 29/00* (2006.01)
*A61F 2/20* (2006.01)

(52) U.S. Cl.
USPC .... 381/71.11; 381/71.8; 381/71.9; 381/71.12

(58) Field of Classification Search
USPC ..... 381/71.11, 71.1, 71.8, 71.4, 71.2, 71.9, 381/71.12, 71.5
See application file for complete search history.

(56) References Cited

U.S. PATENT DOCUMENTS

| | | | | |
|---|---|---|---|---|
| 4,987,598 | A | 1/1991 | Eriksson | |
| 5,117,401 | A | 5/1992 | Feintuch | |
| 5,473,699 | A | 12/1995 | Tamamura et al. | |
| 5,809,152 | A * | 9/1998 | Nakamura et al. | 381/71.8 |
| 5,995,632 | A | 11/1999 | Okada | |
| 6,418,227 | B1 * | 7/2002 | Kuo | 381/71.11 |
| 8,144,888 | B2 * | 3/2012 | Berkhoff et al. | 381/71.11 |
| 8,270,625 | B2 * | 9/2012 | Sommerfeldt et al. | 381/71.12 |
| 8,280,065 | B2 * | 10/2012 | Nadjar et al. | 381/71.1 |
| 2002/0003887 | A1 * | 1/2002 | Zhang et al. | 381/71.1 |
| 2004/0240677 | A1 | 12/2004 | Onishi et al. | |
| 2005/0207585 | A1 * | 9/2005 | Christoph | 381/71.11 |
| 2008/0162072 | A1 * | 7/2008 | Copley et al. | 702/124 |
| 2009/0086990 | A1 * | 4/2009 | Christoph | 381/71.12 |

FOREIGN PATENT DOCUMENTS

EP 1793374 6/2007

OTHER PUBLICATIONS

Rigling et al, "Subspace Leaky LMS" , Feb. 2004; IEEE Signal Processing Letters, vol. 11, No. 2; pp. 136-139.*

Thomas et al; "Eigenvalue equalization filtered-x algroithm for multichannel active noise control of stationary and nonstationary signals"; Jun. 2008; Journal Acoustic Sociaty of America, vol. 123, No. 6.*

Thomas et al; "Eigenvalue equalization filtered-x algorithm for the multichannel active noise control of stationary and nonstationary signal"; Jun. 6, 2008; Acoustic Society of America; vol. 123—Issue 6; p. 4238-4249.*

(Continued)

*Primary Examiner* — Mohammad Islam
*Assistant Examiner* — David Ton
(74) *Attorney, Agent, or Firm* — O'Shea Getz P.C.

(57) ABSTRACT

An active noise cancellation system that reduces, at a listening position, power of a noise signal radiated from a noise source to the listening position. The system includes an adaptive filter, at least one acoustic actuator and a signal processing device. The adaptive filter receives a reference signal representing the noise signal, and provides a compensation signal. The at least one acoustic actuator radiates the compensation signal to the listening position. The signal processing device evaluates and assesses the stability of the adaptive filter.

15 Claims, 14 Drawing Sheets

(56) References Cited

OTHER PUBLICATIONS

Bouchard et al. "Computational Load Reduction of Fact Convergence Algorithms for Multichannel Active Noise Control", Signal Processing, vol. 83, No. 1, Jan. 2003, pp. 123-134.

Kuo et al. "Active Noise Control: A Tutorial Review", Proceedings of the IEEE, vol. 87, No. 6, Jun. 1999, pp. 943-973.

* cited by examiner

ADAPTIVE NOISE CONTROL SYSTEM

1. CLAIM OF PRIORITY

This patent application claims priority to European Patent Application serial number 08 010 843.4 filed on Jun. 13, 2008, which is hereby incorporated by reference in its entirety.

2. FIELD OF TECHNOLOGY

The present invention relates to active noise control and cancelling.

3. RELATED ART

A disturbing noise (also referred to as "noise" or "disturbing sound signals")—in contrast to a useful sound signal—is sound that is not intended to be heard or perceived, for example, by a listener. In a motor vehicle, disturbing noise may further include sound signals generated by mechanical vibrations of an engine and/or components mechanically coupled thereto (e.g., a fan), wind passing over and around the vehicle, and/or tires contacting, for example, a paved surface. Noise generation may be divided into three sub-processes: (1) generation of noise by a noise source; (2) transmission of noise away from a noise source; and (3) radiation of a noise signal.

Suppression of noise may take place directly at the noise source, for example, by damping. Suppression of noise may also be achieved by inhibiting or damping the transmission and/or the radiation of noise. However, in many applications these methods do not adequately reduce the noise, particularly in a bass frequency range, below an acceptable (or predetermined) limit. Additionally or alternatively, noise control systems and methods may be employed that eliminate or at least reduce the noise radiated into a listening room using a destructive interference (i.e., by superposing the noise signal with a compensation signal). These systems and methods are generally referred to by the term "active noise control" (ANC). However, the feasibility of these systems and methods relies on the development of cost effective, high performance digital signal processors, which may be used together with an adequate number of suitable sensors and actuators.

Typically, active noise suppressing or reducing systems (known as "active noise control" systems) generate a compensation sound signal having the same amplitude and the same frequency components as the noise signal to be suppressed. However, the compensation sound signal has a 180° (one hundred eighty degree) phase shift with respect to the noise signal. As a result, the noise signal is eliminated or reduced, at least at certain locations within the listening room, due to the destructive interference between the compensation sound signal and the noise signal.

Modern motor vehicles may include features such as a "rear seat entertainment" system (e.g., multimedia system) that provides a high-fidelity audio presentation using a plurality of loudspeakers arranged within the passenger compartment of the vehicle. Active noise control systems are used to improve the quality of the sound reproduction of the rear seat entertainment systems. In addition, active noise control systems may help facilitate conversations between persons sitting on the front seats and on the rear seats.

Modern active noise control systems implement digital signal processing and digital filtering techniques. Typically, a noise sensor (e.g., a microphone or a non-acoustical sensor) is used to provide an electrical reference signal representing the disturbing noise signal generated by a noise source. The reference signal is fed to an adaptive filter which supplies a filtered reference signal to an acoustic actuator (e.g., a loudspeaker). The acoustic actuator generates a compensation sound field having a phase opposite to that of the noise signal within a defined portion ("listening position") of the listening room. The compensation sound field interacts with the noise signal thereby eliminating or at least damping the noise within the listening position. Residual noise within the listening environment and/or the listening room may be measured using a microphone. The resulting microphone output signal is used as an "error signal" and is provided to the adaptive filter, where the filter coefficients of the adaptive filter are modified such that a norm (e.g., the power) of the error signal is minimized.

Disadvantageously, adaptive filters may become unstable, and therefore cannot reliably ensure stability in all listening environments. Consequently, there is a need to continuously monitor the present operational state of the filter, and to make adjustments thereto where an unstable state of operation is detected. This is frequently accomplished using known digital signal processing methods such as an enhanced version of the least mean squares (LMS) method for minimizing error signals. These enhanced LMS methods include, for example, the so-called filtered-x-LMS (FXLMS) algorithm as well as related methods such as the filtered-error-LMS (FELMS) algorithm.

A model that represents the acoustic transmission path from the acoustic actuator (i.e., loudspeaker) to the error signal sensor (i.e., microphone) is used for applying the FXLMS (or any related) algorithm. This acoustic transmission path from the loudspeaker to the microphone is usually referred to as a "secondary path" of the ANC system, whereas the acoustic transmission path from the noise source to the microphone is usually referred to as a "primary path" of the ANC system. The corresponding process for identifying the transmission function of the secondary path is referred to as "secondary path system identification".

A transmission function (i.e. the frequency response) of the secondary path system of the ANC system may have a considerable impact on the convergence behaviour of an adaptive filter that uses the FXLMS algorithm, and thus on the stability behaviour thereof, and on the speed of the adaptation. The frequency response (i.e., magnitude response and/or phase response) of the secondary path system may be subjected to variations during operation of the ANC system. A varying secondary path transmission function may have a negative impact on the performance of the active noise control, especially on the speed and the quality of the adaptation produced by the FXLMS algorithm. The negative impact is caused when the actual secondary path transmission function is subjected to variations and no longer matches an a priori identified secondary path transmission function that is used within the FXLMS (or related) algorithms.

There is a general need for active noise control with improved speed and quality of adaptation, as well as the robustness of the entire active noise control system. Furthermore there is a need to provide a flexible selection and generation of the reference signal for the FXLMS algorithm.

SUMMARY OF THE INVENTION

According to one aspect of the invention, an active noise cancellation system is configured to reduce, at a listening position, the power of a noise signal radiated from a noise source to the listening position. The system includes an adaptive filter, at least one acoustic actuator and a signal processing device. The adaptive filter receives a reference signal representing the noise signal, and provides a compensation signal. The at least one acoustic actuator is configured to radiate an acoustic signal indicative of the compensation signal to the listening position. The signal processing device is configured to evaluate and assess the stability of the adaptive filter.

According to another aspect of the invention, an active noise cancellation system is configured to reduce, at a listening position, the power of a noise signal radiated from a noise source to the listening position. The system includes a filter arrangement and at least one acoustic actuator. The filter arrangement includes a first adaptive filter and an equalization filter. The filter arrangement receives an effective reference signal representing the noise signal, and provides a compensation signal, where a transfer characteristic of the equalization filter is characterized by a first transfer function. The at least one acoustic actuator is configured to radiate the compensation signal to the listening position, where a signal path between the acoustic actuator and the listening position is characterized by a secondary path transfer function, where the product of the first transfer function and the secondary path transfer function matches a given target function.

According to another aspect of the invention, an active noise cancellation method is provided for reducing, at a listening position, the power of a noise signal radiated from a noise source to the listening position. The method includes: providing a reference signal correlated to the noise signal; filtering the reference signal with an adaptive filter to provide a compensation signal; radiating the compensation signal to the listening position; sensing a residual error signal at the listening position; adapting filter coefficients of the adaptive filter as a function of the error signal and the reference signal; and evaluating and assessing the stability of the adaptive filter.

According to another aspect of the invention, an active noise cancellation method is provided for reducing, at a listening position, the power of a noise signal radiated from a noise source to the listening position. The method includes: providing a reference signal correlated to the noise signal; sequentially filtering the reference signal with an adaptive filter and an equalization filter to provide a compensation signal, where a transfer characteristic of the equalization filter is characterized by a first transfer function; radiating the compensation signal to the listening position with an acoustic actuator, where a signal path from the acoustic actuator to the listening position is characterized by a secondary path transfer function, and where the product of the first transfer function and the secondary path transfer function matches a given target function; sensing a residual error signal at the listening position; and adapting filter coefficients of the adaptive filter as a function of the error signal and the reference signal.

Equalization of the frequency response to the value of the transmission function of the overall secondary path of the active noise control arrangement may improve robustness and stability thereof. For example, the equalization may improve the speed and the performance of the adaptation as well as the robustness of the entire active noise control method executed therewith.

A further advantage may arise when a reference signal, which is formed from a combination of the signals from at least two different sensors, is provided to the active noise control arrangement. These sensors may be acoustic and/or non-acoustical sensors.

Still a further advantage may arise, when the reference signal and the residual error signal which is provided to the filtered-x-LMS algorithm, is filtered with an adaptive band-pass filter in such a manner that the algorithm adapts substantially to the harmonic of interest or to the harmonics of an interfering signal with the greatest amplitude.

Robustness is further increased due to the stability detection which allows the system to take opportune actions when unstable states of operation are detected. As a result, the system may reassume a stable state, or at least the adverse effects of instability are alleviated, faster.

DESCRIPTION OF THE DRAWINGS

The components in the drawings are not necessarily to scale; instead emphasis is placed upon illustrating the principles of the invention. Moreover, in the drawings, like reference numerals designate corresponding parts. In the drawings.

DETAILED DESCRIPTION

Active noise control systems ("ANC systems") are used to suppress noise. For example, an ANC system may improve music reproduction or speech intelligibility in an interior of a motor vehicle. In another example, an ANC system may increase the quality of acoustic signals output from an active headset (e.g., a headset including an ANC system). The basic principle of such active noise control arrangements is based on the superposition of an existing undesired interfering signal with a compensation signal. The compensation signal, which has an opposite phase to that of the noise signal, is generated by the ANC system and added to the undesired disturbing noise signal. Ideally, by adding the compensation signal to the noise signal, the noise signal is completely suppressed.

Figure 1:
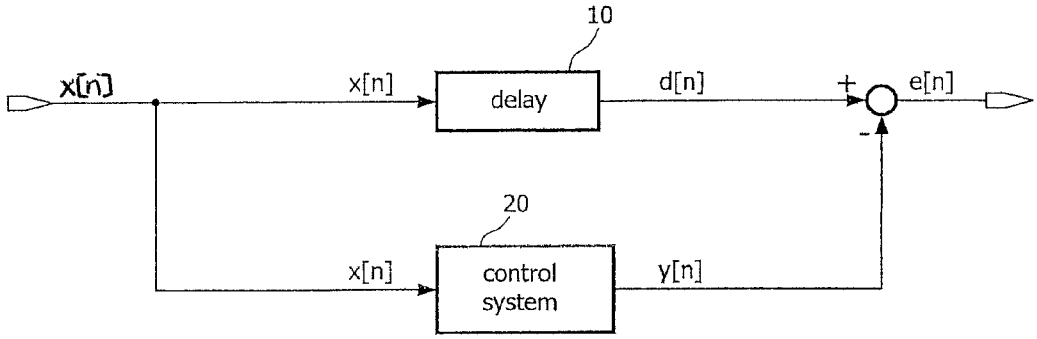
FIG. 1 is a block diagram illustration of a feedforward circuit.
Figure 2:
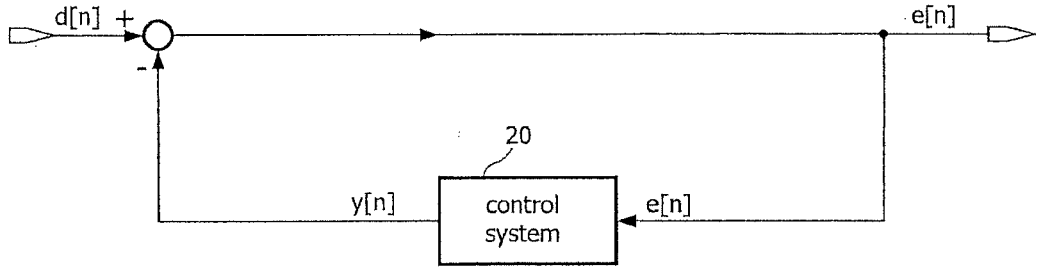
FIG. 2 is a block diagram illustration of a feedback circuit.

A feedforward control is characterized in that a signal which is correlated to the undesired disturbing noise (also referred to as a "reference signal") is used for driving a compensation actuator. In acoustic ANC systems, the compensation actuator is a loudspeaker. In contrast, a feedback system is characterized in that the system response is measured and redirected before driving the compensation actuator. In practice, the "system" is the overall transmission path from the noise source to a listening position where noise cancellation is desired (hereinafter referred to as a "listening position"). The "system response" to a noise input from the noise source is represented by at least one microphone output signal that is fed back via a control system to the compensation actuator (e.g., a loudspeaker). The compensation actuator generates "anti-noise" (also referred to a "compensation signal") for suppressing the actual noise signal in a desired position/location. FIGS. 1 and 2 are block diagram illustrations of a feedforward structure (illustrated in FIG. 1) and a feedback structure (illustrated in FIG. 2) for generating a compensation signal that at least partially compensates for, and ideally eliminates, the undesired disturbing noise signal.

It is known in the art that feedforward systems are typically more effective than feedback arrangements, in particular due to the possibility of the broadband reduction of disturbing noises. This is a result of the fact that a signal representing the disturbing noise may be directly processed and used to actively counteract the disturbing noise signal. Such a feedforward arrangement is illustrated in FIG. 1.

FIG. 1 illustrates the signal flow in a basic feedforward structure/circuit. An input signal "x[n]" (e.g., a disturbing noise signal or a signal derived therefrom and correlated thereto) is supplied to a primary path system 10 and a control system 20. The primary path system 10 may impose a delay to the input signal x[n], for example, due to the propagation of the disturbing noise from the noise source to a location in the listening room (i.e., the listening position) where a suppression of the disturbing noise signal should be achieved (i.e., to the desired "point of silence"). The delayed input signal is denoted as "d[n]". Now referring to FIG. 2, the noise signal x[n] in the control system 20 is filtered such that the filtered input signal "y[n]", when superposed with the delayed input signal d[n], compensates for the noise due to destructive interference in the considered portion of the listening room (i.e., the listening position). Referring again to FIG. 1, the output signal of the feed-forward structure is indicative of an error signal "e[n]" which is a residual signal including the signal components of the delayed input signal d[n] that were not suppressed by the superposition with the filtered input signal y[n]. The signal power of the error signal e[n] may be regarded as a quality measure for the noise cancellation achieved.

In feedback systems (see FIG. 2), the effect of interference on the system is initially delayed. Noise suppression (i.e., active noise control) may be performed when a sensor determines the effect of the interference. An advantageous effect of the feedback systems is that it may be effectively operated even where a suitable signal correlating with the disturbing noise is not available for controlling the active noise control arrangement. This is the case, for example, when using ANC systems in environments that are not a priori known and where specific information about the noise source is not available.

Referring now to FIG. 2, an input signal d[n] of an undesired acoustic noise is suppressed by a filtered input signal (i.e., compensation signal y[n]) provided by the feedback control system 20. The residual signal (i.e., error signal e[n]) is input to the feedback loop 20.

Noise suppression arrangements are typically adaptive since the noise level and the spectral composition of the noise, which is to be reduced, is generally subjected to chronological changes due to changing ambient conditions. For example, when ANC systems are used in motor vehicles, the ambient conditions may change due to fluctuation of wind and tire noises at different driving speeds, different load states and engine speeds or by one or a plurality of open windows.

It is known in the art that an unknown system may be iteratively estimated by an adaptive filter. The filter coefficients of the adaptive filter are modified such that the transfer characteristic of the adaptive filter approximately matches the transfer characteristic of the unknown system. In ANC applications, digital filters are used as adaptive filters, for examples finite impulse response (FIR) filters or infinite impulse response (IIR) filters whose filter coefficients are modified according to a given adaptation algorithm.

Typically, adaptation of the filter coefficients is a recursive process which, for example, permanently optimizes the filter characteristic of the adaptive filter. This may be accomplished by minimizing an error signal that is essentially the difference between the output of the unknown system and the adaptive filter, wherein both are supplied with the same input signal. The transfer characteristic of the adaptive filter approaches the transfer characteristic of the unknown system where a norm of the error signal approaches zero. Therefore, in ANC applications the unknown system may represent the transmission path (i.e., a primary path) the noise signal travels from the noise source to the spot/location where noise suppression is to be achieved (i.e., the listening position). The noise signal is thereby "filtered" by the transfer characteristic of the primary signal path (i.e., a primary path transfer function) which—in case of a motor vehicle—includes mostly the passenger compartment. The primary path may additionally include the transmission path from the actual noise source (e.g., the engine, the tires, etc.) to the car-body and further into the passenger compartment.

Figure 3:
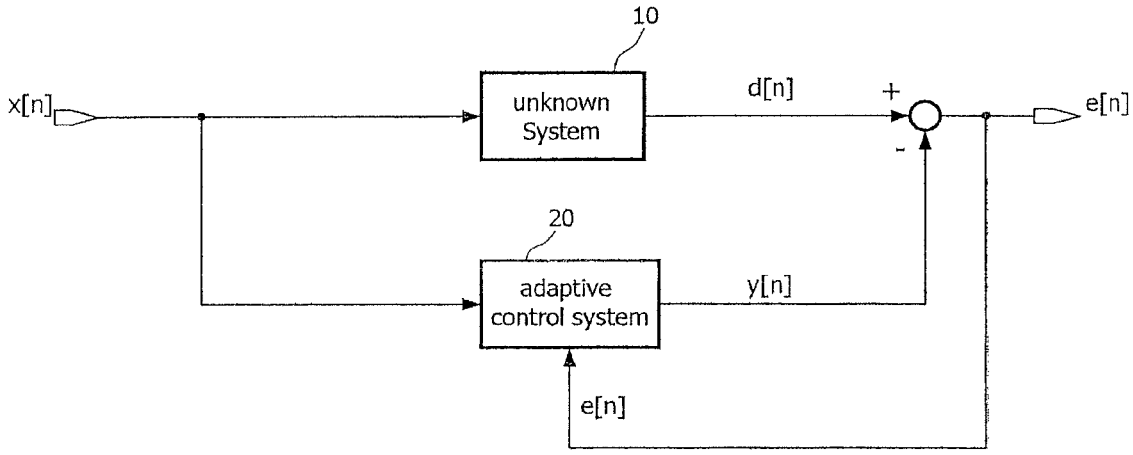
FIG. 3 is a block diagram illustration of a system for estimating an unknown system using an adaptive filter.

FIG. 3 is a block diagram illustration of a system for estimating/determining an unknown system 10 using an adaptive filter 20. An input signal x[n] is supplied to the unknown system 10 and to the adaptive filter 20. The output signal d[n] of the unknown system 10 and the output signal y[n] of the adaptive filter 20 are destructively superposed (i.e., subtracted) and the residual signal (i.e., the error signal e[n]) is provided/fed back) to the adaptation algorithm implemented in the adaptive filter 20. A least mean square ("LMS") algorithm may, for example, be employed for calculating modified filter coefficients such that the norm of the error signal |e[n]| is reduced. In this example, an optimal suppression of the output signal d[n] of the unknown system 10 is achieved.

The adaptive filter, which may be implemented in a digital signal processor ("DSP"), uses the LMS algorithm to approximate the solution for least square means problems. The algorithm is based on the "method of the steepest descent" (also referred to as "gradient descent method") and computes the gradient in a relatively "simple" manner. The algorithm thereby operates in a time-recursive manner. That is, after a first iteration, the algorithm is run through again and the solution is updated with each new data set provided. Due to its relatively small complexity and small memory requirement, the LMS algorithm is often used for adaptive filters and/or for adaptive controls, which may be realized in digital signal processors. Alternative methods may include, but are not limited to, recursive least squares, QR decomposition least squares, least squares lattice, QR decomposition lattice or gradient adaptive lattice, zero-forcing, stochastic gradient and so forth.

Figure 4A:
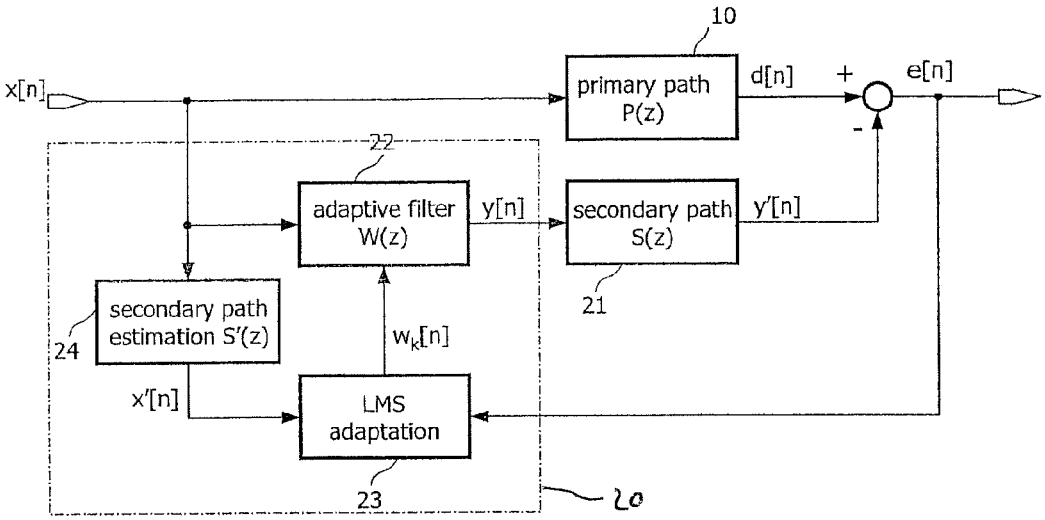
FIGS. 4A and 4B are block diagram illustrations of a single-channel active noise control system using, respectively, a filtered-x-LMS (FXLMS) algorithm and a modified filtered-x-LMS (MFXLMS) algorithm.

In active noise control arrangements, the filtered-x-LMS (FXLMS) algorithm and modifications and extensions thereof may be used as special embodiments of the LMS algorithm. One example of such a modification is the "modified filtered-x-LMS" (MFXLMS) algorithm. The basic structure of the filtered-x-LMS algorithm is illustrated in FIG. 4A. To simplify, components such as, for example, amplifiers, analog-to-digital converters and digital-to-analog converters are not illustrated herein. All signals are denoted as digital signals with the time index "n" placed in squared brackets (i.e., "[n]").

The ANC system of FIG. 4A includes a primary path system 10, a secondary path system 21, and an active noise control unit 20. The active noise control unit 20, which may be implemented in a digital signal processor, includes an adaptive filter 22, a LMS adaptation unit 23 and a secondary path estimation system 24. The primary path system 10 has a transfer function "P(z)" representing the transfer characteristics of the signal path between the noise source and the portion of the listening room where the noise is to be suppressed. The adaptive filter 22 has a filter transfer function "W(z)". The adaptation unit 23 is adapted for calculating an optimal set of filter coefficients $w_k=(w_0, w_1, w_2, \ldots)$ to provide to the adaptive filter 22. The secondary path system 21 has a transfer function "S(z)" and is configured downstream of the adaptive filter 22. The secondary path system 21 represents the signal path (i.e., transmission path) from the loudspeaker radiating the compensation signal to the listening position. An estimation "S'(z)" (e.g., through system 24) of the secondary path transfer function S(z) is used for calculating the optimal filter coefficients with the FXLMS algorithm. The primary path system 10 and the secondary path system 21 are "real" systems representing the physical properties of the listening room, wherein the other transfer functions are implemented in a digital signal processor.

The input signal x[n] represents the noise signal generated by a noise source and therefore is also referred to as a "reference signal". The input signal x[n] is measured, for example, by an acoustic or non-acoustical sensor and is supplied to the primary path system 10, the adaptive filter 22 and the secondary path estimation system 24. When using a non-acoustical sensor, the input signal may be indirectly derived from the sensor signal. The primary path system 10 provides an output signal d[n]. The adaptive filter 22 provides a filtered signal y[n] having a 180 degree phase shift to that of the input signal x[n]. The filtered signal y[n] is supplied to the secondary path system 21 which provides a modified filtered signal y'[n] that destructively superposes with the output signal d[n] of the primary path system 10. The "result" of the superposition is a measurable residual signal used as an error signal e[n] for the LMS adaptation unit 23. An estimated model of the secondary path transfer function S(z) is used for calculating updated filter coefficients $w_k$. The estimated model compensates for the decorrelation between the noise signal x[n] and the error signal e[n] due to the signal distortion in the secondary path. The estimated secondary path system 24, having a transfer function S'(z), provides a modified input signal x'[n] to the adaptation unit 23.

Functionally, the system in FIG. 4A is summarized as follows. The transfer function W(z)·S(z) from the series connection of the adaptive filter 22 and the secondary path 21 approaches the transfer function P(z) of the primary path 10 due to the adaptation process (i.e., wherein the output signal d[n] of the primary path 10 and the output signal y'[n] of the secondary path 21 superpose destructively thereby suppressing the effect of the input signal x[n] in the considered portion of the listening room). The residual error signal e[n] measured, for example, using a microphone, and the modified input signal x'[n] provided by the estimated secondary path transfer function S'(z) are supplied to the adaptation unit 23. The adaption unit 23 calculates, for example using an LMS algorithm, the filter coefficients $w_k$ for the transfer function W(z) of the adaptive filter 22 from the modified input signal x'[n] ("filtered x") and the error signal e[k] such that a norm of the error signal |e[k]| becomes relatively small (i.e., it is minimized). It should be noted that alternatives or modifications of the "filtered-x-LMS" algorithm, such as, for example, the "filtered-e-LMS" algorithm, may also be used by the adaptation unit 23.

The adaptivity of the algorithms realized in a digital ANC system, such as the above-mentioned FXLMS algorithm, may cause instabilities therein. Typically, such instabilities are also inherent to many further adaptive methods. These instabilities may, for example, cause self-oscillations of the ANC systems and similar undesired effects which may be perceived as a particularly unpleasant noise such as whistling, screeching, etc. Instabilities may occur in adaptive ANC arrangements which use LMS algorithms for the adaptation of the filter characteristics when the reference signal rapidly changes chronologically, and thus includes, e.g., transient, impulse-containing sound portions. For example, these instabilities may result where the convergence parameter or the step size of the adaptive LMS algorithm is not chosen properly for an adaptation to impulse-containing sounds.

Figure 4B:
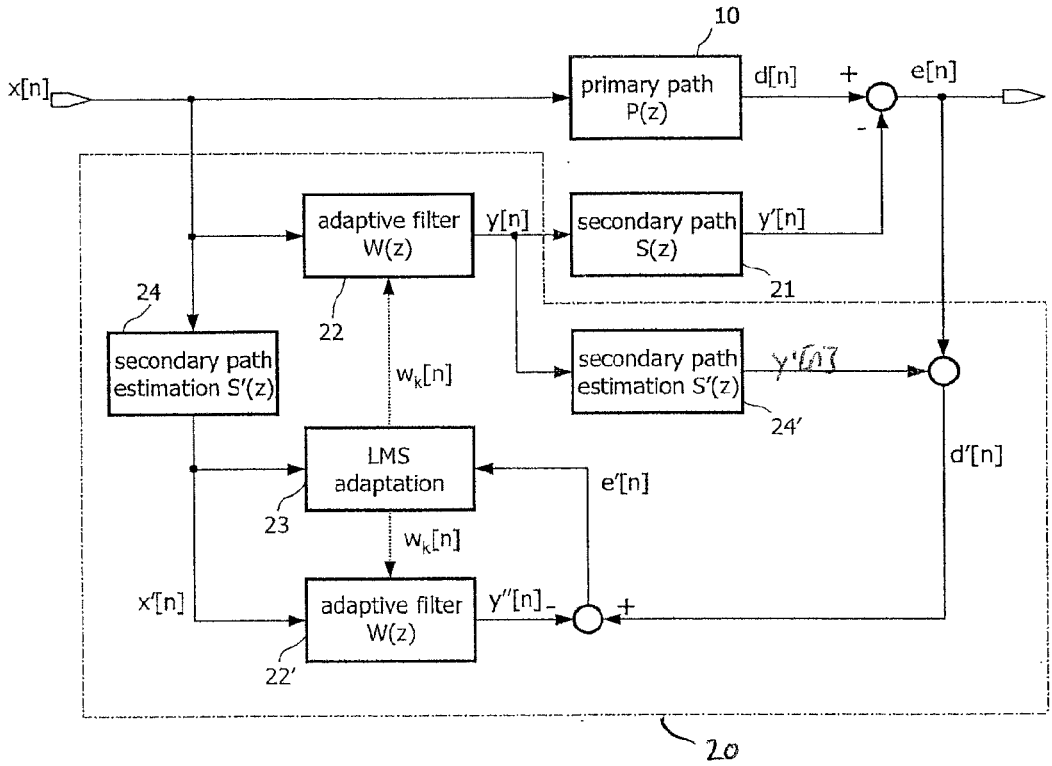

FIG. 4B is a block diagram illustration of an active noise control system that uses a modified version of the FXLMS algorithm (i.e., the "modified filtered-x-LMS algorithm" (MFXLMS)). In contrast to the system of FIG. 4A, the ANC system of FIG. 4B includes an additional adaptive filter 22' ("shadow filter") and an additional estimated secondary path filter 24'. The filter characteristic of the adaptive filter 22 upstream to the "real" secondary path 21 and the filter characteristic of the shadow filter 22' are identical and adapted the LMS adaptation unit 23. The secondary path filter 24' receives the compensation signal y[n] and provides an estimation of the secondary path output y'[n]. The estimation of the secondary path output y'[n] is added to the error signal e[n] which, similarly to the system of FIG. 4A, is generated/provided by a microphone disposed in the location where noise cancellation is desired. The resulting sum is an estimation d'[n] of the primary path output d[n]. Therefrom, the output y''[n] of the shadow filter 22' is subtracted from the estimation d'[n] to provide a modified error signal e'[n] used for LMS adaptation of the filter coefficients $w_k[n]$ of the adaptive filters 22 and 22'. The adaptive filter 22 receives the reference signal x[n], whereas the shadow filter 22' and the LMS adaptation unit 23 receive the filtered reference signal x'[n].

Referring to the ANC system of FIG. 4A, the speed of convergence (i.e., the maximum adaptation step size) is reduced compared to an "ordinary" LMS algorithm due to additional delay by pre-filtering the reference signal x[n] in the secondary path estimation system 24 with a transfer function S'(z) according to the FXLMS algorithm. In contrast, in the ANC system of FIG. 4B, the additional delay of the pre-filtering with the estimated secondary path system 24 is avoided by adapting the filter coefficients of the shadow filter 22', since the shadow filter 22' and the LMS adaptation unit 23 receive the same signal (i.e., the filtered reference signal x'[n]). Therefore, the adaptation is performed on the shadow filter 22' and the updated filter coefficients $w_k[n]$ are provided regularly to the adaptive filter 22 which provides the compensation signal y[n].

The adaptation step-size of the MFXLMS algorithm may be larger than the maximum step-size of the "simple" FXLMS algorithm due to the reduced delay. This results in a faster convergence of the MFXLMS algorithm as compared to the FXLMS algorithm. In addition, the robustness of the system is improved since sensitivity of errors in magnitude and phase in the transfer function S'(z) of the secondary path estimation system 24 is reduced compared to the FXLMS algorithm.

Figure 5:
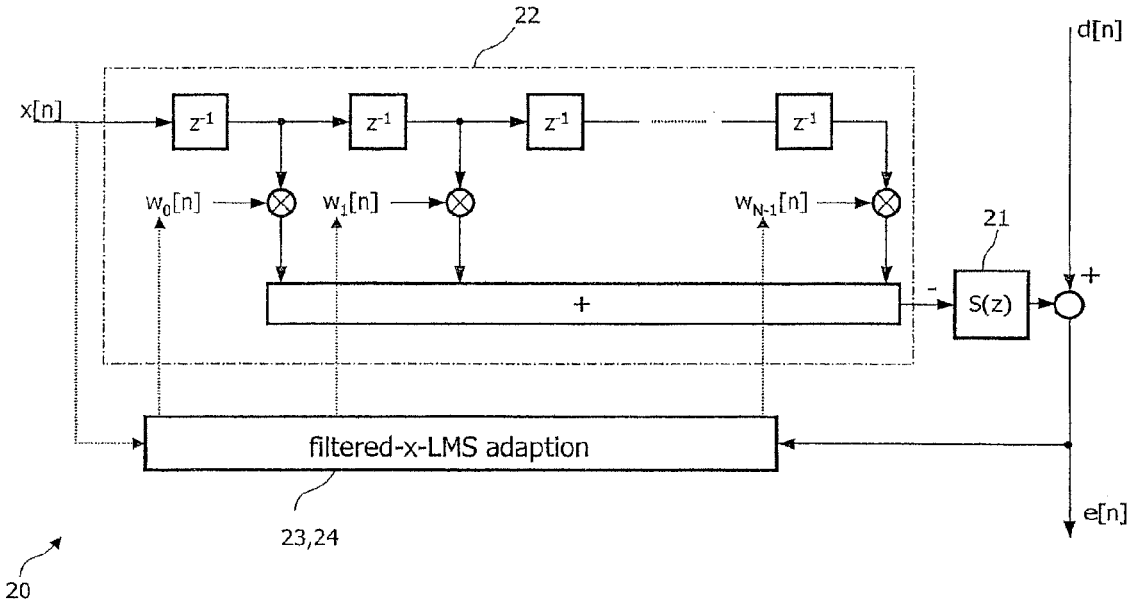
FIG. 5 is a block diagram illustration a mode of operation of the LMS algorithm.

FIG. 5 is a block diagram illustration a mode of operation of the LMS algorithm. In particular, FIG. 5 illustrates the adaptive filter 22 in FIGS. 4A and 4B in more detail. The reference signal x[n] is a first input signal for the adaptive LMS algorithm, and the signal d[n] is a second input signal, which arises from the unknown system (primary path 10) and is distorted by the transfer function P(z) thereof.

The manner in which both of the input signals are generated depend on the actual application. As set forth above, these input signals may be acoustic signals, which are converted into electric signals by microphones as part of acoustic ANC systems. The electrical representation of the reference signal x[n], which represents the undesired noise signal of a noise source, may also be generated by non-acoustical sensors such as, but not limited to, piezoelectric vibration sensors, revolution sensors in combination with oscillators for synthesizing the reference signal, etc.

FIG. 5 illustrates a basic block diagram of a N-th order FIR filter 22 which converts the reference signal x[n] into a signal y[n]. The N filter coefficients of the adaptive filter are denoted as $w_i[n]=\{w_0[n], w_1[n], \ldots, w_N[n]\}$, where the index "n" is a time index indicating that the coefficients are not fixed, but regularly updated by the adaptation algorithm. As such, the adaptation algorithm iteratively adapts the filter coefficients $w_i[n]$ of the adaptive filter 22 until the error signal e[n], which represents the difference between the signal d[n] and the filtered reference signal y[n], is reduced or minimized.

Generally, both of the input signals (i.e., the reference signal x[n] and the distorted signal d[n]) are stochastic signals. Where the reference signal is synthesized, it is a composition of sine and cosine waves. In case of acoustic ANC systems, the input signals (e.g., x[n] and d[n]) are noisy measuring signals, i.e. audio signals. The power of the error signal e[n] (e.g., the mean square error ("MSE")) may be used as quality criterion for the adaptation, where $$\mathrm{MSE}=E\{e^2[n]\}.$$

The quality criterion expressed by the MSE may be minimized/reduced using a "simple" recursive algorithm (e.g., the least mean square (LMS) algorithm).

In the LMS method, the function to be minimized is the square of the error. That is, to determine an improved approximation for the minimum of the square of the error, the estimated gradient, multiplied by a constant, is added to the last previously-determined approximation (method of steepest descent). The finite impulse response of the adaptive FIR filter is chosen to be at least as long as (i.e., the filter order must be chosen accordingly) the relevant portion of the unknown impulse response of the unknown system to be approximated, such that the adaptive filter has sufficient degrees of freedom to minimize the error signal e[n]. The filter coefficients are thereby gradually changed in the direction of the negative gradient of the mean square error MSE, wherein convergence parameter "μ" controls the step-size.

A typical LMS algorithm for computing the filter coefficients $w_i[n]$ of an $N^{th}$-order adaptive FIR filter may be described as follows, whereby in the FXLMS algorithm signal x[n] is replaced by x'[n] (see FIG. 4A):

$$w_i[n+1]=w_i[n]+2\cdot\mu\cdot e[n]\cdot x[n-i] \text{ for } i=0, \ldots, N-1.$$

The updated filter coefficients $w_i[n+1]$ correspond to the old filter coefficients $w_i[n]$ plus a correction term, which is a function of the error signal e[n] (see FIG. 4A) and of the value x[n−i] in the delay line of the filter (see FIG. 5). The LMS convergence parameter μ thereby represents a measure for the speed and for the stability of the adaptation of the filter.

As known in the art, the adaptive filter (i.e., a FIR filter) may be converted to a "Wiener filter" in response to the use of the LMS algorithm, when the following applies for the convergence factor μ:

$$0<\mu<\mu_{max}=1/[N\cdot E\{x^2[n]\}],$$

wherein "N" represents the order of the FIR filter and "$E\{x^2[n]\}$" represents the expected value of the signal power of the reference signal x[n]. In practice, the convergence parameter μ may be selected such that $\mu=\mu_{max}/10$.

The LMS algorithm for adapting the coefficients of the adaptive FIR filter may be summarized as follows:

1. Initialization of the algorithm:
   Set a control variable to n=0.
   Selection of start coefficients $w_i[n=0]$ for i=0, . . . , N−1 at the onset of the execution of the algorithm, where $w_i[0]=0$ for i=0, . . . , N−1 represents a suitable selection, because e[0]=d[0] applies at the beginning of the algorithm.
   Selection of the amplification factor (step size) $\mu<\mu_{max}$, typically $\mu=\mu_{max}/10$.
2. Reading a value of the reference signal x[n] and of the signal d[n], which is distorted by the unknown primary path system.
3. FIR filtering of the reference signal x[n] with the FIR filter defined by the coefficients $w_i[n]$ (i=0, 1, 2, . . . , N−1).
4. Determination of the error: e[n]=d[n]−y[n].
5. Updating of the coefficients according to:

$$w_i[n+1]=w_i[n]+2\cdot\mu\cdot e[n]\cdot x[n-i] \text{ for } i=0, \ldots, N-1.$$

6. Preparation of the next iteration step:
   n→n+1 and return and continue from step 2.

The convergence parameter μ (i.e., the step size) influences both the speed of convergence of the adaptation filter and the "quality" of the mean-square-error (MSE). For example, the greater the convergence parameter μ is chosen for between individual integration steps, the faster the adaptation filter converges. In another example, the smaller the convergence parameter μ is chosen, the smaller the eventual deviation is to the iteratively approached target value (i.e., the smaller the error signal e[n] attained by the adaptive filter becomes). A small error signal e[n], ideally an error signal e[n]=0, is desirable so as to attain the most effective noise reduction (i.e., the most complete elimination of the error signal in the listening position). However, the smaller the convergence parameter μ is chosen, the greater number of iteration steps may be needed for approaching the desired target value. As a result, the required convergence time of the adaptive filter may increase. As a result, in practice, a compromise is struck between (1) the quality of the approach to the target value and (2) the quality of the attainable noise reduction and of the speed of the adaptation of the underlying algorithm when selecting the convergence parameter μ.

In view of the desired attainable accuracy of the adaptation of the active noise control arrangement, a relatively small step size μ may be chosen. However, an undesirable effect of a small step size μ is that the adaptation of the LMS algorithm cannot adapt itself in a sufficiently rapid manner to correct for a rapidly changing reference signal/noise signal. Such rapid changes may be due to transient, impulse-containing sound portions. As a result, an elimination may not reduce the impulse-containing sound portions to the desired extent. Under some circumstances, as set forth above, a small step size μ may lead to an undesired instability of the entire adaptive active noise control arrangement in response to rapidly changing signals.

The quality of the estimation (i.e., the transmission function S'(z), see FIGS. 4A and 4B) of the secondary path 24 with the transmission function S(z) of the secondary path 21 represents another factor for the stability of an active noise control arrangement on the basis of the FXLMS algorithm (see FIG. 4A). The deviation of the estimation S'(z) of the secondary path 24 from the transmission function S(z) of the secondary path 21 with respect to magnitude and phase thereby plays an important role in convergence and the stability behaviour of the FXLMS algorithm of an adaptive ANC arrangement and thus in the speed of adaptation. In this context, this is oftentimes also referred to as a "90° criterion". Deviations in the phase between the estimation of the secondary path transmission function S'(z) and the actually present transmission function S(z) of the secondary path of greater than +/−90° thereby lead to an instability of the adaptive active noise control arrangement. The above-mentioned MFXLMS algorithm (see FIG. 4B) is more robust than the FXLMS algorithm with regards to deviations in the phase between the estimation transfer function S'(z) and the actual transfer function S(z).

Instabilities may still occur even with the improved MFXLMS algorithm, for example, where the ambient conditions in an interior of a motor vehicle change during operation. For example, the opening of a window while the vehicle is driving (i.e., moving) may considerably change the acoustic environment and thus also the transmission function of the secondary path of the active noise control arrangement, among other things. This change may further lead to an instability of the entire arrangement.

In such a case, the transmission function of the secondary path may no longer be approximated to a sufficiently high degree by using the a priori determined estimation, as may be used in the systems of FIGS. 4A and 4B. A dynamic system identification of the secondary path, which adapts itself to the changing ambient conditions in real time, may be used where there are dynamic changes of the transmission function of the secondary path S(z) during operation of the ANC system.

The dynamic system identification of the secondary path system may be realized using an adaptive filter arrangement, which is connected in parallel to the secondary path system (see FIG. 3). Optionally, a suitable measuring signal, which is independent of the reference signal of the active noise control arrangement, may be fed into the secondary path for improving dynamic and adaptive system identification of the secondary path transmission function. The measuring signal for the dynamic system identification may be, for example, a noise-like signal or music. One example for an ANC with dynamic secondary path approximation is described later with reference to FIG. 7.

Figure 6A:
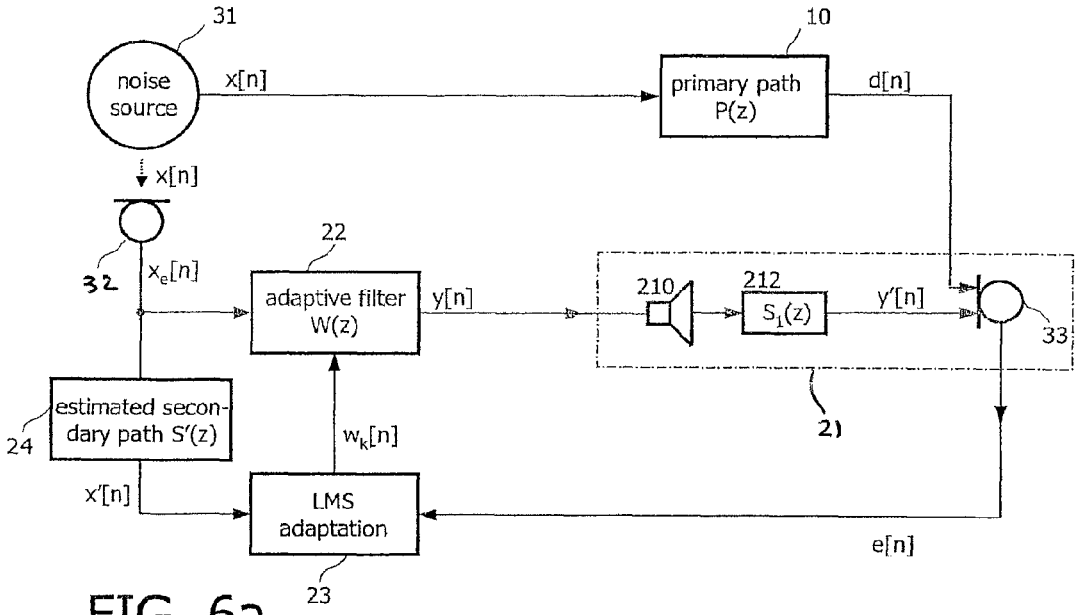
FIG. 6A is a block diagram illustration of the active noise control system of FIG. 4A.

FIG. 6A is a diagrammatic illustration of a system for active noise control according to the structure of FIG. 4A. However in contrast, the system of FIG. 6A illustrates a noise source 31 generating the input noise signal x[n] for the ANC system and includes a microphone 33 for sensing the residual error signal e[n]. The noise signal generated by the noise source 31 serves as the input signal x[n] to the primary path system 10. The primary path system 10 provides an output signal (i.e., the noise signal x[n]) to be suppressed. An electrical representation $x_e[n]$ of the input signal x[n] may be provided by an acoustic sensor 32 (e.g., a microphone, a vibration sensor, etc.) which is sensitive in the audible frequency spectrum or at least in a broad spectral range thereof. The electrical representation $x_e[n]$ of the input signal x[n] (i.e., the sensor signal) is supplied to the adaptive filter 22. The filtered signal y[n] is supplied to the secondary path 21. The output signal of the secondary path 21 is a compensation signal y'[n] for destructively interfering with the noise signal d[n] filtered by the primary path 10. The residual signal is measured with the microphone 33 whose output signal is supplied to the adaptation unit 23 as the error signal e[n]. The adaptation unit calculates (e.g., using the FXLMS algorithm) optimal filter coefficients $w_i[n]$ for the adaptive filter 22. Since the acoustic sensor 32 may detect the noise signal generated by the noise source 31 in a broad frequency band of the audible spectrum, the arrangement of FIG. 6A is used for broadband ANC applications.

Figure 6B:
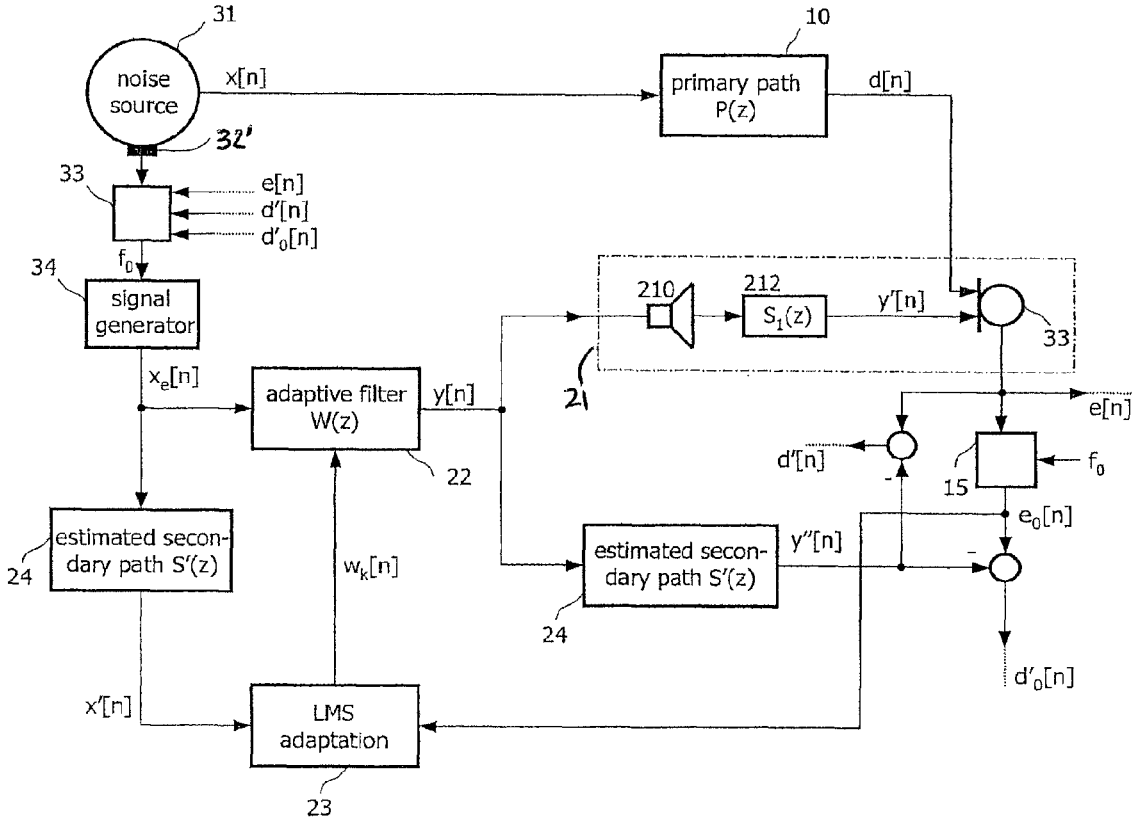
FIG. 6B is a block diagram illustration of an alternative active noise control system including a non-acoustical sensor.

Referring now to FIG. 6B, in narrowband ANC applications, the acoustic sensor 32 may be replaced by a non-acoustical sensor 32' in combination with a base frequency calculation unit 33 and a signal generator 34 for synthesizing the electrical representation $x_e[n]$ of the reference signal $x_e[n]$. The signal generator 34 may use the base frequency $f_0$ and higher order harmonics for synthesizing the reference signal $x_e[n]$. The non-acoustical sensor 32' may be, for example, a revolution sensor that provides information on the rotational speed of an engine which may correspond to associated noise signals. Additionally to the broadband system of FIG. 6A, the narrowband version (see FIG. 6B) further includes a band-pass filter 15 for filtering the residual error signal e[n] provided by microphone 33, and providing a narrowband error signal $e_0[n]$. The narrowband error signal $e_0[n]$ is provided to the LMS adaptation unit 23 for adaptation. The band-pass filter 15 may have one or more pass bands with center frequencies at integer multiples of the base frequency $f_0$ (i.e., a pass bands around the center frequencies $n \cdot f_0$, for n=1, 2, . . . , N where N−1 is the number of higher order harmonics).

The base frequency calculation unit 33 may extract the base frequency $f_0$ of the noise signal from the output of the non-acoustical sensor (e.g., the revolution sensor connected to the engine) or, additionally or alternatively, from the error signal e[n], a simulated primary path output d'[n], or a filtered primary path output $d'_0[n]$. The simulated primary path output d'[n] is generated by adding the output signal y''[n], estimated by the secondary path system 24, and the measured residual error signal e[n]. In contrast to the system of FIG. 6A, the band-pass filtered error signal $e_0[n]$ is added to the output signal y''[n] for the calculation of a filtered primary path output $d'_0[n]$. However, where the quality of the non-acoustical sensor signal is sufficient to extract the base frequency $f_0$ therefrom, a calculation of simulated primary path signals d'[n] or $d'_0[n]$ is not necessary.

In modern automobiles the sensor signal from the revolution sensor 32' may be provided as a digital bus signal via, for example, a CAN-bus with a relatively low sampling rate (e.g., about 10 samples per second). This low sampling rate may result in poor noise damping performance of the ANC system (e.g., slow reactions to rapid changes of rotational speed and thus rapid changes in the reference/noise signal x[n]). To avoid such adverse effects, the base frequency may be extracted from other suitable signals, for example, from the aforementioned simulated primary path output signals d'[n], $d'_0[n]$ using, for example, adaptive notch filters, Kalman frequency trackers or other suitable systems and/or methods.

Figure 7:
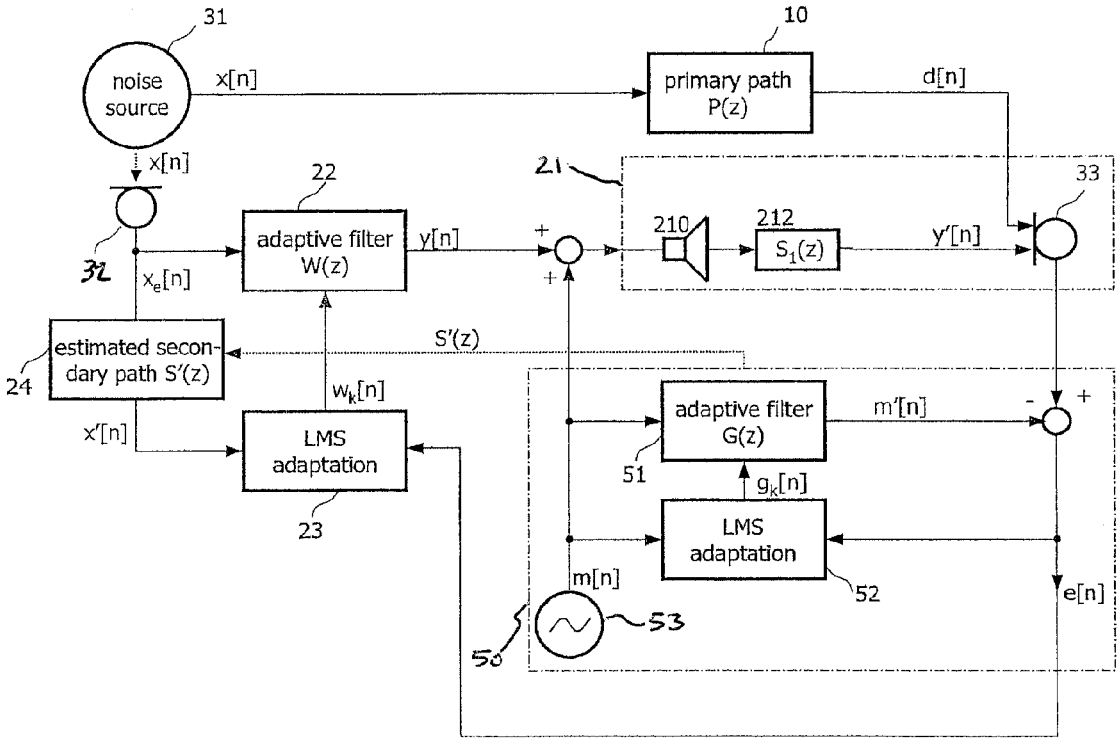
FIG. 7 is a block diagram illustration of an active noise control system having secondary path estimation.

FIG. 7 is a block diagram illustration of an active noise control system based on the system of FIG. 6A. However, the system of FIG. 7 provides an additional dynamic estimation of the secondary path transfer function S'(z) that is used within the FXLMS algorithm. That is, the system of FIG. 7 includes an additional secondary path estimation system 50 for estimating the secondary path transfer function S(z). The estimated secondary path transfer function S'(z) may be used within the FXLMS algorithm for calculating the filter coefficients of the adaptive filter 22 as set forth above. The secondary path estimation system 50 is similar to the system of FIG. 3.

The secondary path estimation system 50 includes an adaptive filter 51, a LMS adaptation system 52 and a measurement signal generator 53. The adaptive filter 51 is connected in parallel to the transmission path of the sought secondary path system 21. A measurement signal m[n] is generated by a measurement signal generator 53 and superposed (i.e., added) to the compensation signal y[n] (i.e., to the output signal of the adaptive filter 22). The output signal m'[n] of the adaptive filter 51 is subtracted from the microphone signal providing the resulting residual signal e[n]. The residual signal e[n] is used as an error signal for calculating updated filter coefficients $g_k[n]$ for the adaptive filter 51. The updated filter coefficients $g_k[n]$ are calculated using the LMS adaptation unit 53. The transfer function G(z) of the adaptive filter 51 follows the transfer function S(z) of the secondary path 21, for example, even where the transfer function S(z) varies over time. The transfer function G(z) may be used as an estimation S'(z) of the secondary path transfer function within the FXLMS algorithm.

It may be desirable to dynamically adjust the measuring signal m[n] with reference to its level and its spectral composition such that even though it covers the respective active spectral range of the variable secondary path (i.e., system identification), it is, at the same time, inaudible in the listening position for listeners. This may be attained in that the level and the spectral composition of the measuring signal are dynamically adjusted in such a manner that this measuring signal is always reliably covered or masked by other signals, such as speech or music.

The arrangement for the dynamic approximation of the transmission function of the secondary path of an ANC system (e.g., the secondary path estimation system 50 of FIG. 7) is technically difficult to achieve, which increases the costs thereof. Furthermore, in practice, it is not always possible to reliably ensure that each dynamic change of the secondary path of an ANC system is considered in an estimation of an adaptive dynamic secondary path system. Therefore, it may not be possible to reliably exclude unstable operating states.

Depending on the application, it may be necessary to continuously determine the present operational state, regarding stability, of the ANC system which, for example, may not include an adaptive dynamic system identification of the secondary path. Further, it may be necessary to identify "stable" and "unstable" states of the ANC system. From these identified states, appropriate actions may be taken, which may include, for example, a temporary shutdown of the ANC system. By taking appropriate actions, it is possible to implement technically less complex and more cost effective ANC systems, for example, without a dynamic system identification of the secondary path, while being able to reliably ensure, in the case of unstable operating states, that the unstable states may be identified and that corresponding actions may be initiated.

Figure 8:
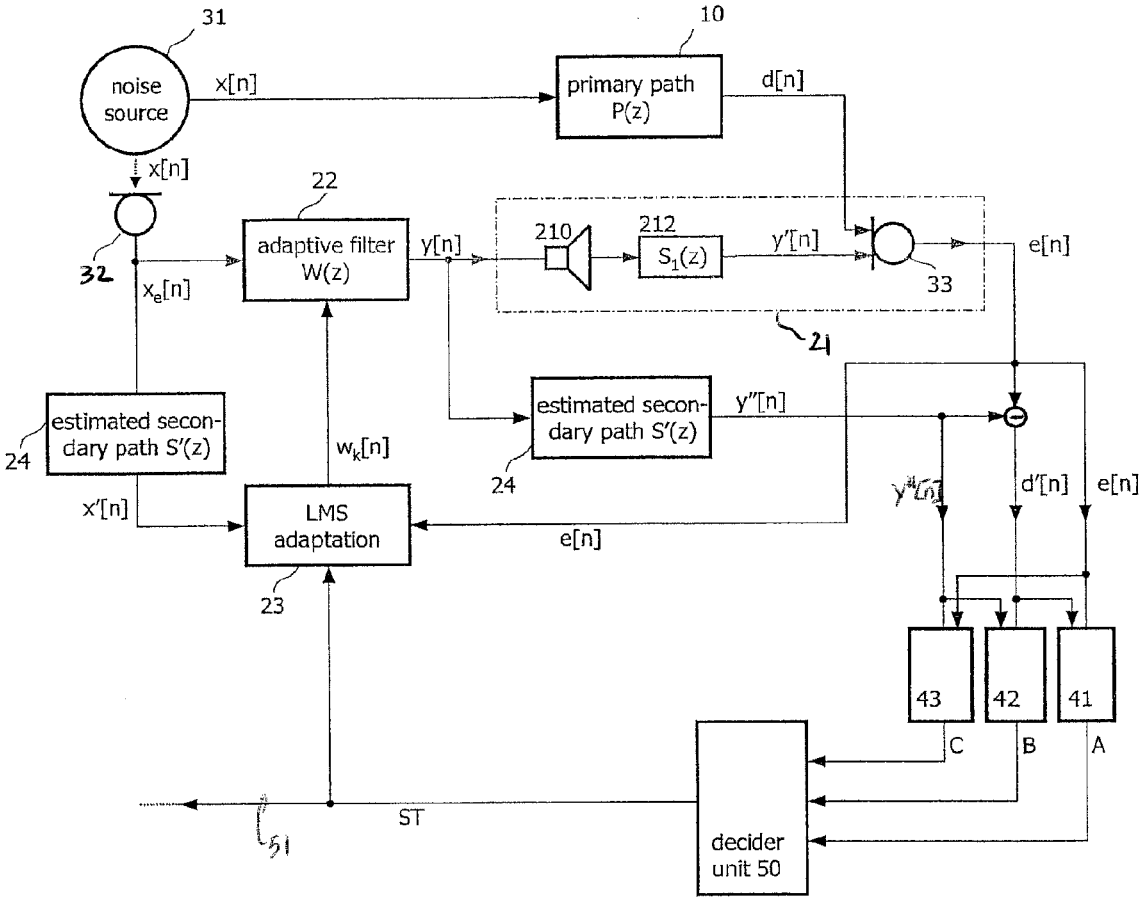
FIG. 8 is a block diagram illustration of an active noise control (ANC) system having stability detection.

FIG. 8 is a block diagram illustration of an active noise control system for identifying unstable operating states of an ANC system using the FXLMS algorithm. Although the system of FIG. 8 is illustrated using a feedforward arrangement (see FIG. 1), it also contemplated that it may use a feedback arrangement (see FIG. 2).

FIG. 8 illustrates one embodiment of a system for active noise control similar to the system of FIG. 6, which is a feed-forward ANC system. The ANC system of FIG. 8 includes a noise source 31 generating a noise signal x[n]. This noise signal is distorted by the primary path system 10 that has a transfer function P(z) representing the transfer characteristics of the signal path between the noise source and the listening position (i.e., the portion of the listening room where the noise is to be suppressed). The distorted noise signal at the listening position is denoted by the symbol d[n], which also denotes the output signal of the primary path system 10.

The ANC system of FIG. 8 includes an adaptive filter 22 having a filter transfer function W(z) and an adaptation unit 23 for calculating an optimal set of filter coefficients $w_k=(w_0, w_1, w_2, \ldots)$ for the adaptive filter 22. The adaptive filter 22 receives an electrical representation $x_e[n]$ of the noise signal x[n], for example, from an acoustic sensor 32 (e.g., a microphone or a vibration sensor sensitive in the audible spectrum) or, additionally or alternatively, by a non-acoustical sensor with an additional synthesizing of the reference signal $x_e[n]$ as shown in FIG. 6B. The filter output signal y[n] (i.e., the compensation signal) is supplied to the secondary path system 21 having a transfer function $S_1(z)$ that is arranged downstream of the adaptive filter 22. The secondary path system 21 includes an electro-acoustic transducer 210 (e.g., a loudspeaker), the signal path (transmission path) from the loudspeaker radiating the compensation signal to the listening position (e.g., the position of microphone 33), the microphone 33 and A/D-converters. For the sake of simplicity the A/D-converters and amplifiers are not shown in the figures.

As set forth with reference to FIG. 4A, an estimation S'(z) (via system 24) of the secondary path transfer function S(z) is used with the FXLMS algorithm for the calculation of the optimal filter coefficients. The primary path system 10 and the secondary path system 21 are "real" systems representing the physical properties of the listening room, the sensors, the actuators, the A/D- and D/A-converters as well as other signal processing components, wherein the other transfer functions are implemented in a digital signal processor.

The compensation signal y[n] is supplied to the secondary path system 21 whose output signal y'[n] destructively superposes with the output signal d[n] provided by the primary path system 10 by phase shifting the signal path by 180° (degrees). The "result" of the superposition is a measurable residual signal that is used as an error signal e[n] for the adaptation unit 23. An estimated model of the secondary path transfer function S(z) is used, as set forth with reference to FIG. 4A, for calculating updated filter coefficients $w_k$.

In addition to the elements in FIG. 6A, the ANC system of FIG. 8 includes an estimation d'[n] of the primary path output signal d[n] provided by subtracting (e.g., via a subtractor) an estimation y"[n] of the compensation signal y'[n], provided by the estimated secondary path system 24, from the error signal e[n], provided by the microphone 33. This estimated secondary path system 24 is connected downstream of the adaptive filter 22 and simulates the behavior of the "real" secondary path 21.

The error signal e[n], the estimated noise signal d'[n] and the estimated compensation signal y"[n] are each supplied to signal processing units 41, 42, and 43, respectively. The signal processing units 41, 42, 43 are adapted to perform functions such as, but not limited to, band-pass filtering, Fourier-transforming, signal power estimating, etcetera.

The outputs of the signal processing units 41, 42, 43 are connected to corresponding inputs of a decider unit 50, which is connected downstream thereof. The decider unit 50 provides a control signal "ST" to the LMS adaptation unit 23.

The ANC system and at least part of the functional blocks are implements using of one or more digital signal processors. In alternate embodiments, the ANC system and the functional blocks may be implemented using analog circuits or a hybrid of digital and analog devices/systems.

The acoustic reference signal x[n] (i.e., the noise signal) of signal source 31, which is converted into an electric signal $x_e[n]$ by the acoustic sensor 32, may be processed in a narrow-band or broad-band manner or its spectral composition may be changed, for example, by filtering. Of course, as already discussed with reference to FIG. 6B, the acoustic sensor 32 may be replaced by a signal generator connected with a non-acoustical sensor (e.g. rotational speed sensor).

In addition to the acoustic transmission path 212 (having a transmission function $S_1(z)$) and the electro-acoustic transducer 212 (e.g., loudspeaker), the secondary path system 21 may include corresponding amplifiers (not shown), and, where appropriate, digital-to-analog ("D/A") and analog-to-digital ("A/D") converters (not shown). The distorting effects of the at least one microphone 33 and, for example, subsequent amplifiers and A/D or D/A converters may also be included in the secondary path system 21. That is, the secondary path transfer function S(z) may take into account the distorting effects of the overall signal path from the output signal y[n] of the adaptive filter 22 to the error signal e[n] provided by the microphone 33 for the disturbing noise d[n] equal zero.

As a function of the operating state, which is determined by the decider unit 50, certain parameters of the ANC system may subsequently be influenced, for example, to counteract the danger of an unstable operating state, to increase the adaptation speed and the adaptation accuracy, or, to shut down the active noise control arrangement. The results of the evaluation performed by the decider unit 50, via the output signal ST, are available for optional control of other components of the overall ANC system via line 51, for example external components.

Figure 9:
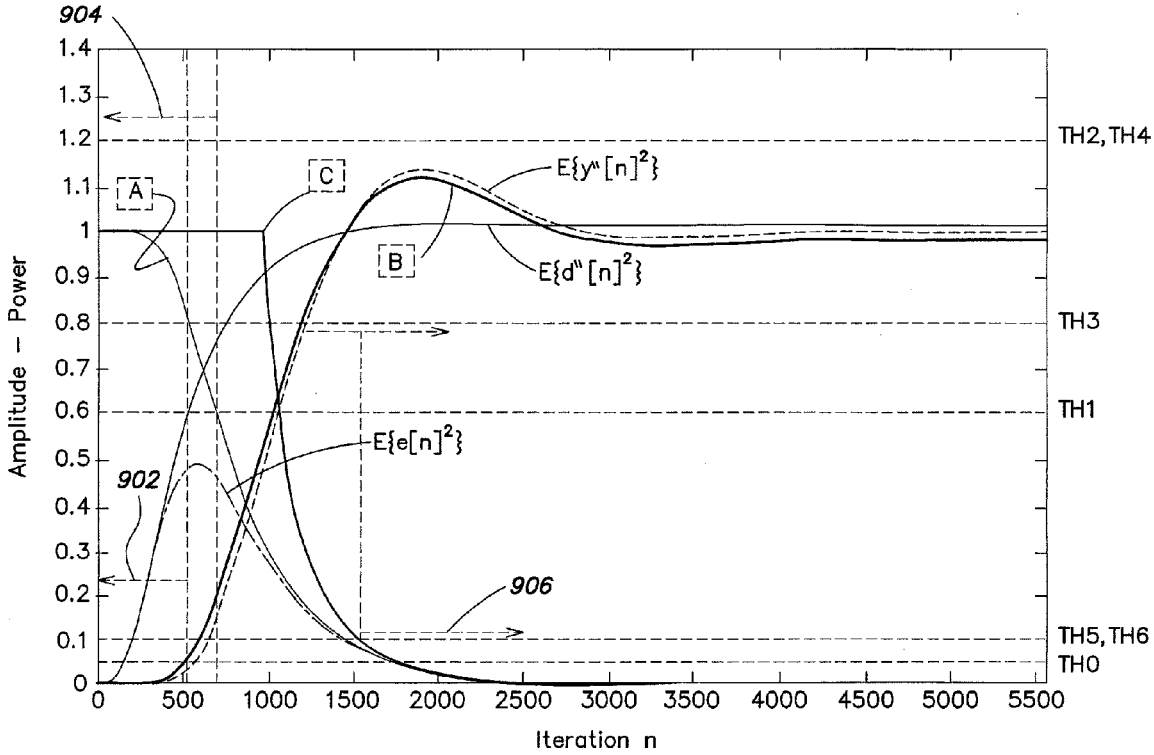
FIG. 9 graphically illustrates a system response of the active noise control system of FIG. 8.

FIG. 9 graphically illustrates one embodiment of the system response and the typical course of the signals y"[n] (i.e., the estimated secondary path output signal), d'[n] (i.e., the estimated primary path output signal, that is, the disturbance to be suppressed), and e[n] (i.e., the residual error signal) for the time period of the first 5500 iteration steps after the turn-on procedure of the system. The input signal x[n] (i.e., the reference signal) is, in the present example, given by:

$$x[n]=u[n]\cdot\sin(2\pi\cdot f_0\cdot n/f_{SAMP}),$$

wherein "u[n]" is the Heaviside function (i.e., unity step), "$f_0$" is the base frequency of the disturbing noise (see FIG. 6B) and "$f_{SAMP}$" is the sampling frequency used within the digital signal processing system. In the present example, the "noise" (i.e., the reference signal x[n]) is a harmonic oscillation with a frequency $f_0$.

FIG. 9 illustrates an example of tuning the ANC system into a stable state, wherein the noise that is to be reduced (i.e., the disturbance signal d[n]) and the transmission function S(z) of the secondary path of the system are stable (i.e., do not change) in the considered time interval.

The time in the unit iteration steps (e.g., 0 to 5500 iteration steps) are plotted on the abscissa (i.e., the x-axis), while the normalized signal power of the respective signals is plotted on the ordinate (i.e., the y-axis). As illustrated, the signal d'[n] rises from the value 0 in iteration step 0 after approximately 2000 iteration steps to a stable value (e.g., 1) after the turn-on procedure and after the onset of the iteration of the system, respectively.

The error signal e[n] initially increases in the same manner as the signal d'[n], since during the first approximately 300 iteration steps, it is not yet possible to provide a compensation signal y[n] for destructively superposing to the disturbance signal d[n] using the adaptive filter and the FXLMS algorithm of the ANC system. Furthermore, from FIG. 9, it is shown that with iteration steps of greater than approximately 300, the simulated secondary path output signal y"[n] begins rising and at least partial noise compensation begins. After approximately 4500 iteration steps, the simulated secondary path output signal y"[n] reaches a steady state with a mean signal strength level, which is substantially equal to the signal level of the simulated disturbing noise signal d'[n].

With the rise of the secondary path output signal y"[n], the error signal e[n] decreases during the same time interval from approximately iteration step 300 to iteration step 4500, and asymptotically reaches zero in the steady state of the adaptive filter 23 of the exemplary ANC system of FIG. 8.

A conclusion about the stability of the ANC system of FIG. 8 may be drawn by evaluating the error signal e[n], the (simulated) disturbance d'[n] and the (simulated) secondary path output signal y"[n] by the signal processing units 41, 42, and 43. For stability detection, three normalized variables A, B, C are calculated within the signal processing units 41, 42, and 43, which is discussed below in further detail.

Variable A may represent a relation between the error signal e[n] and the (simulated) disturbance signal d'[n], for example where $A=E\{e[n]^2\}/E\{d'[n]^2\}$, and thus represents the quality of the active noise cancellation. The operator "$E\{e[n]^2\}$" represents the expected value of the power of a signal e[n], wherein the expected value is calculated by averaging (see FIG. 10). The variable A may also represent an attenuation factor "$10\cdot\log_{10}(A)$" measured in decibel. The better the attenuation of the disturbance d[n] (and d'[n] respectively) the higher is the probability that the overall ANC system will operate stable and remain in a stable state of operation.

Variable B may represent a relation between the (simulated) disturbance d'[n] and the (simulated) secondary path output signal y"[n], for example where $B=E\{y''[n]^2\}/E\{d'[n]^2\}$. Since after a successful adaptation of the adaptive filter 22 (see FIG. 8) the secondary path output signal y[n] asymptotically approximates the disturbance signal d[n] and therefore the simulated signals are approximately equal (i.e., $y''[n]\approx d'[n]$) after the ANC system has reached steady state. The variable B will be in a certain interval around the value 1 during a stable state of operation. This interval may range, for example, from approximately 0.8 to 1.2.

Variable C may represent a relation between the error signal e[n] and the (simulated) secondary path output signal y"[n], for example where $C=\min\{1, E\{e[n]^2\}/E\{y''[n]^2\}\}$, and thus represents another way of characterizing the actual attenuation of the disturbance signal d[n] (and d'[n] respectively). After a successful adaptation of the adaptive filter 22 (see FIG. 8), the secondary path output signal y[n] asymptotically approximates the disturbance signal d[n]. Therefore, the simulated signals are approximately equal after the ANC system has reached steady state. As a result, variable C, similarly to variable A, may be interpreted as a damping factor during a stable state of operation.

The stability variables A, B, and C are evaluated in the decider unit 50 for determining whether the ANC system is operating in a stable state of operation. For this purpose the following conditions may be evaluated:

Condition 1: B<TH0. That is, the variable B is smaller than a defined first threshold TH0 wherein TH0 is much smaller than 1. The ANC system complies with this condition when the secondary path output signal y'[n] (and the simulated signal y"[n] respectively) is relatively much smaller than the disturbance signal d[n] or the simulated disturbance signal d'[n]. In FIG. 9, this condition is met during the first 500 samples, which is approximately the "dead time" of the ANC system. During this time period (n=0, . . . , ~500) the system is not yet able to provide a compensating output signal y'[n] for suppressing the disturbance d[n]. However, this also means that the system is unable to induce instabilities. Therefore, the system operates in a stable state of operation when condition 1 is true. This state is labelled as 902 in FIG. 9.

Condition 2: TH1<A<TH2. That is, the variable A is within the interval ranging from the lower threshold TH1 to the upper threshold TH2, wherein TH1 is lower than 1 (e.g., 0.6) and TH2 is greater than 1 (e.g., 1.2). Where this condition is met, the error signal e[n] is within the same order of magnitude as the disturbance signal d[n] (respectively d'[n]) and the system may be regarded as stable. The state of operation in which this condition is met (e.g., during the first 700 samples) is labelled as 904 in FIG. 9. During this state, the power of the output signal y'[n] begins to increase and active noise cancellation becomes effective, although a full suppression of the disturbance is not yet achieved.

Condition 3: (C<TH5), (A<TH6) and (TH3<B<TH4). That is, the variable C is below a threshold TH5, the variable A is below a threshold TH6, and the variable B is within the interval ranging from a lower threshold TH3 to a upper threshold TH4. The thresholds TH5 and TH6 are much smaller than 1 (e.g., 0.1). That is, the damping of the disturbance is at least −10 dB (minus ten decibels). The thresholds TH3 and TH4 are, for example, approximately 0.8 and 1.2, respectively. That is, the (simulated) output signal y"[n] is within for example, ±20 percent around the (simulated) disturbance signal d'[n]. This condition, labelled as 906, illustrates the stationary state of operation which is also regarded as stable.

The ANC system is regarded as stable where one of the above three conditions is evaluated as "true" by the decider unit 50. In contrast, the ANC system is regarded as unstable where none of the above conditions are met (i.e., evaluated as "true").

Referring to FIG. 9, the system is regarded as unstable in the time interval ranging approximately from sample 700 to 1500. However, counteractive measures are not necessary in order to restore stability of the ANC system since this time interval of instability is relatively short. In other words, the instability from, for example, sample 700 to 1500 is a short transient that should not trigger any counteracting action.

In order to distinguish short transients from undesired instabilities, counteracting actions are, for example, only taking where the ANC system operates in an instable state of operation for more than a given time span. In practice, the stability variables A, B, C and the above conditions for stability (condition 1 to 3) are not continuously (i.e. at every sampling instance) evaluated. Rather, the stability variable A, B and C are evaluated for intervals which are relatively longer than a typical sampling interval, for example, in intervals of about 0.5 ms to 2 ms (e.g. 1500 samples per second).

Actions may be taken where the system is evaluated as unstable, for example, at every time instance where stability is evaluated. In order to make the system more robust, a counter may be increased where the system is evaluated as unstable and decreased where evaluated as stable and the counter exceeds a predefined maximum value, actions are taken against instability. This algorithm may be written as follows:

```
COUNTER = 0
calculate A, B, and C
if condition 1 is TRUE then UNSTABLE = −1
else if condition 2 is TRUE then UNSTABLE = −1
else if condition 3 is TRUE then UNSTABLE = −1
else UNSTABLE = 1
COUNTER = COUNTER + UNSTABLE
if COUNTER > COUNTERMAX then take action against instability
```

In the above example "COUNTER" is the counter variable, "UNSTABLE" is a variable which is set to a positive value (e.g., 1) where the system is evaluated as unstable and to a negative value (e.g., −1) where the system is evaluated as stable. It will be clear to a person skilled in the art that many equivalent algorithms exist that fulfil the same function as the one above.

The ANC system may be muted to counteract against instability. Furthermore, the unstable state of operation may be signalled via the status signal ST (see line 51 in FIG. 8) to external components. As a response to a signal ST indicating instability of the ANC system, a secondary path system identification may be triggered (see FIG. 7) in order to obtain an updated estimation S'(z) of the secondary path transfer function S(z). This may be useful, since instability may occur due to a mismatch between the transfer characteristics of the actual secondary path system S(z) and the estimated secondary path system S'(z).

In addition, the step-size μ or the leakage parameter λ of the LMS algorithm may be modified such that the algorithm becomes more robust where there is an unstable state of operation of the ANC system. In this case the above-mentioned step 5 of the LMS algorithm may be expressed as follows:

5. Updating of the coefficients according to:

$$w_i[n+1]=\lambda\cdot w_i[n]+2\cdot\mu\cdot e[n]\cdot x[n-i] \text{ for } i=0, \ldots, N-1.$$

Other useful measures may be taken too. Furthermore, different measures may be taken depending on how long the instable state of operation lasts (i.e., at different values of the counter variable COUNTER). In the present example, the possible counteracting measures have different priority wherein the last and strongest measure, namely to mute the ANC system, may be the last action where other measures (e.g., modification of step size and leakage parameter) are not effective.

Figure 10A:
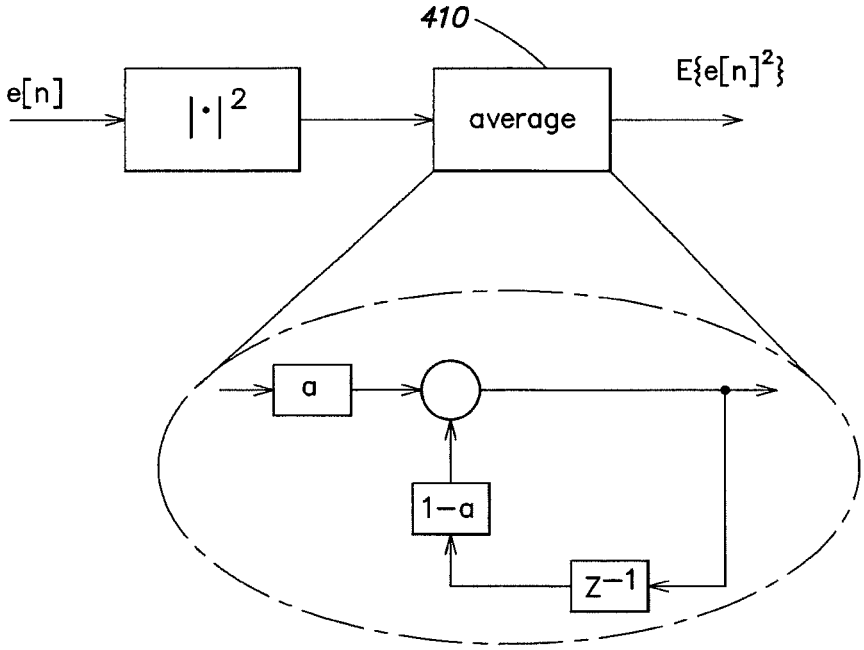
FIGS. 10A and 10B illustrate parts of the signal processor used in the ANC system of FIG. 8.
Figure 10B:
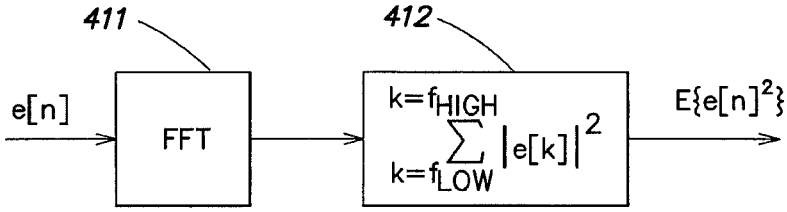

FIGS. 10A and 10B, illustrates two possibilities for calculating signal power in the signal processing units 41, 42, and 43. FIG. 10A illustrates a system for calculating the signal power in the time domain for the use mainly in broad band ANC systems. In contrast, FIG. 10B illustrates a system for calculating the signal power in the frequency domain which may be especially useful in a narrow band ANC system. However, the calculation in the frequency domain may also be used in broad band applications. Conversely, a calculation in the time domain may be used in narrow band applications.

In the time domain, the amplitude of the respective signal (e.g., the error signal e[n]) is squared and averaged by an averaging filter 410. The averaging filter 410 may be configured as a first order AR ("auto regressive") filter with a filter parameter "a" between 0 and 1 (e.g., 0.95). In the frequency domain, the power spectral density is calculated using a Fast Fourier Transform (block 411) with a subsequent summation of the power values over the frequency range ($f_{LOW}$ to $f_{HIGH}$) of interest.

As set forth above, the shape of the secondary path transfer function is directly proportional to the performance and the stability of the FXLMS or MFXLMS algorithms used within the active noise cancellation system. To improve stability of and avoid unstable states of operation of the ANC, the "effective" secondary path transfer function may be equalized by a transfer function C(z) of a compensation filter 26 connected upstream to the "real" secondary path system 21 (see FIGS. 7 and 11-13). For equalization, the actual secondary path transfer function S(z) is estimated, for example, as set forth above with respect to FIG. 7. The compensation filter C(z) upstream to the secondary path is chosen such that the overall transfer function C(z)·S(z) matches a predefined target function. Thus, the ANC system, for example, always "sees" the same secondary path, although the physically present secondary path transfer characteristic varies over time. Moreover a "flat" effective secondary path transfer function C(z)·S(z) improves the performance of the FXLMS algorithm with respect to adaptation speed and robustness. Applications of this "secondary path compensation" are described below with reference to FIGS. 11 to 14.

Figure 11:
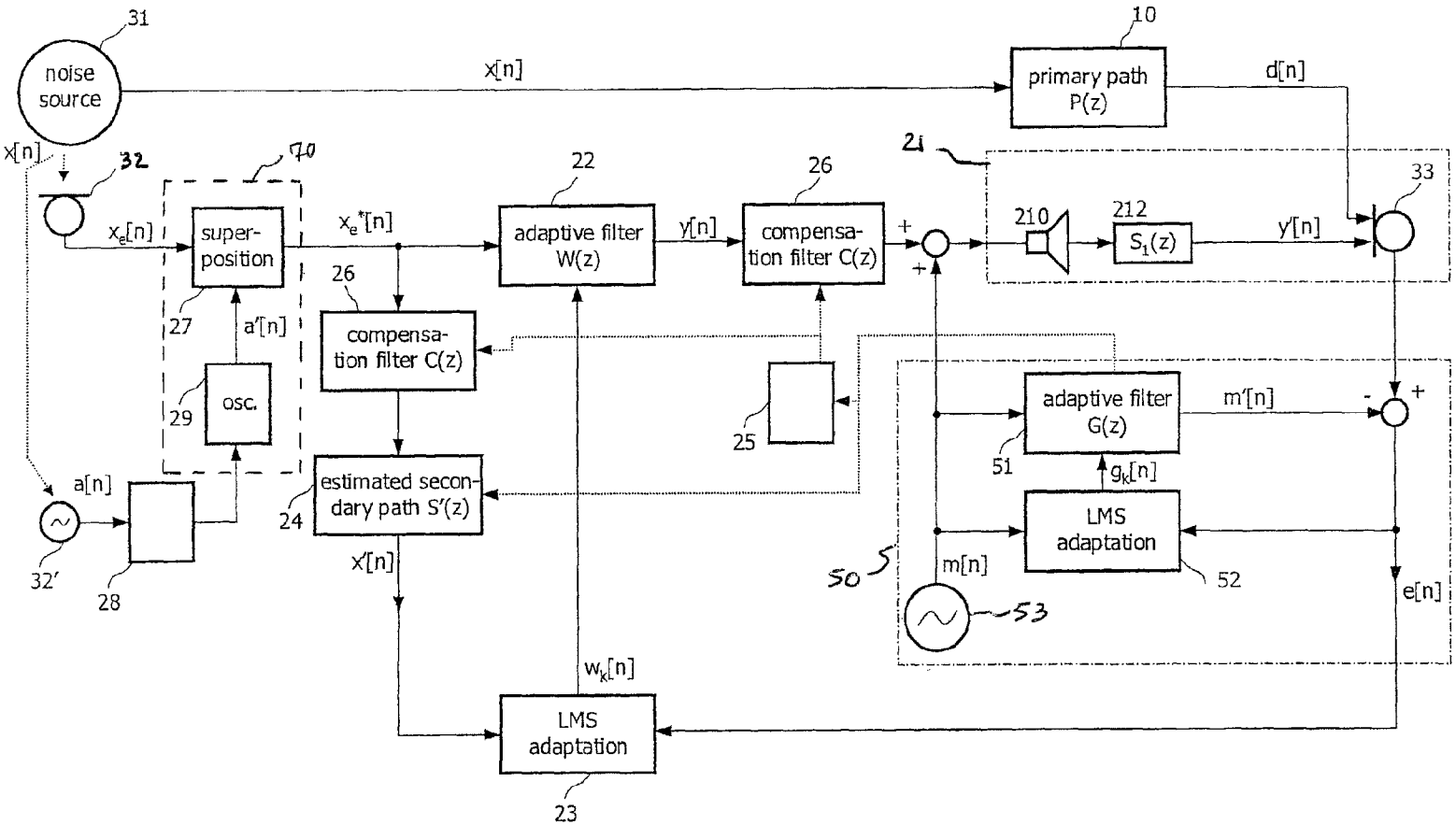
FIG. 11 is a block diagram illustration of an improved broad band ANC system including secondary path compensation filters.

FIG. 11 is a block diagram illustration of a broad band ANC system using the above described FXLMS algorithm. The ANC system includes, in addition to the components of the system of FIG. 7, a secondary path compensation filters 26 having a transfer function C(z) for providing equalization. The system of FIG. 11 may also include a superpositioning system 70 for superposing the electrical reference signal $x_e[n]$ provided by an acoustic sensor 32 (e.g., an acceleration sensor or a microphone) with a second input signal a[n] provided by a non-acoustical sensor 32' (e.g., a rotational speed sensor of a motor vehicle). The superpositioning system 70 includes an oscillator 29 and a superposition device 27 (e.g., an adder) providing a weighted superposition of its input signals at its output.

The output signal of the sensors 32' (e.g., rotational speed sensors) may include information on the base frequency of both the reference signal x[n] and its electrical representation $x_e[n]$. As a result, the output signal a[n] of the sensor 32' typically may not be directly superposed. Therefore, a second reference signal a'[n], mixed with the reference signal $x_e[n]$, is generated by the oscillator 29 whose oscillation frequency (or frequencies) are controlled by a "base frequency extractor" 28 that receives the second input signal a[n]. The base frequency extractor 28 determines the fundamental frequency $f_0$ of the second input signal a[n] and controls the oscillation frequency of the oscillator 27. Thus, the second reference signal a'[n] includes the base frequency $f_0$ and is strongly correlated with the reference signal $x_e[n]$. Alternatively, the oscillator 29 may provide a superposition of harmonic oscillations of the base frequency $f_0$ and higher order harmonics.

The adder 27 is connected downstream to the acoustic sensor 32, receiving the electric reference signal $x_e[n]$ and providing a modified reference signal $x_e^*[n]$. In the present example, the "effective" reference signal $x_e^*[n]$ is supplied to the adaptive filter 22, which takes the place of the reference signal $x_e[n]$ in the previous examples.

The use of a weighted superposition of two reference signals (e.g., $x_e[n]$ and a[n]) for generating the effective reference signal $x_e^*[n]$ has several advantages. The first reference signal $x_e[n]$ may be a broadband sensor signal representing the noise generated by the noise source 31, whereas the second reference signal a'[n] may be a narrow-band representation of the noise generated by the noise source 31. Therefore, the second reference signal a'[n] may be generated by an oscillator or a synthesiser controlled by signal a[n] (see FIG. 11). Depending on the quality of the both reference signals $x_e[n]$, a'[n] the first one, or the second one, or any weighted superposition thereof is used as the effective reference signal $x_e^*[n]$ for the present ANC system. In other embodiments, additional reference signals may also be combined into one effective reference signal $x_e^*[n]$.

The output signal y[n] of the adaptive filter 22 is supplied to the secondary path compensation filter 26, which is connected upstream to the secondary path 21 (i.e., the loudspeaker 210). In order to provide a proper function of the FXLMS algorithm for optimizing the filter coefficients of the adaptive filter 22, another secondary path compensation filter 26 is used upstream of the estimated secondary path system 24 in the signal path supplying the filtered effective reference signal $x_e^*[n]$ to the LMS adaptation unit 23.

In the present example, the dynamic secondary path estimation system 50 works similarly to the estimation system 50 of FIG. 7. The estimated secondary path transfer function S'(z) is used in the system 24. In addition, the estimated secondary path transfer function S'(z) is further processed by a "coefficient extraction unit" 25 that extracts filter coefficients supplied to the secondary path compensation filters 26.

The compensation filters are adapted to compensate the effects (e.g., magnitude, phase or magnitude and phase) of the secondary path 21 (or system 21'). Ideally, the transfer function C(z) of the compensation filters 26 is equal to the inverse of S(z) (i.e., $C(z)=S^{-1}(z)$), where S(z) is the secondary path transfer function. In practice, the transfer function $S^{-1}(z)$ is calculated from the estimated secondary path transfer function S'(z). Alternatively, for example, only the magnitude response |S(z)| of the estimated secondary path transfer function may be considered, and the transfer function C(z) of the compensation filters 26 may be calculated as $C(z)=|S(z)|^{-1}$ plus, optionally, an additional time delay to ensure causality of the compensation filter. In still another embodiment, only the phase response arg {S(z)} of the estimated secondary path transfer function is inverted. It should be noted that the estimated secondary path transfer function S'(z) is not necessarily invertible (i.e., the inverted filter $S^{-1}(z)$ is not necessarily causal). Thus, to ensure causality, an additional time delay may have to be added to the compensation filter 26.

Figure 12:
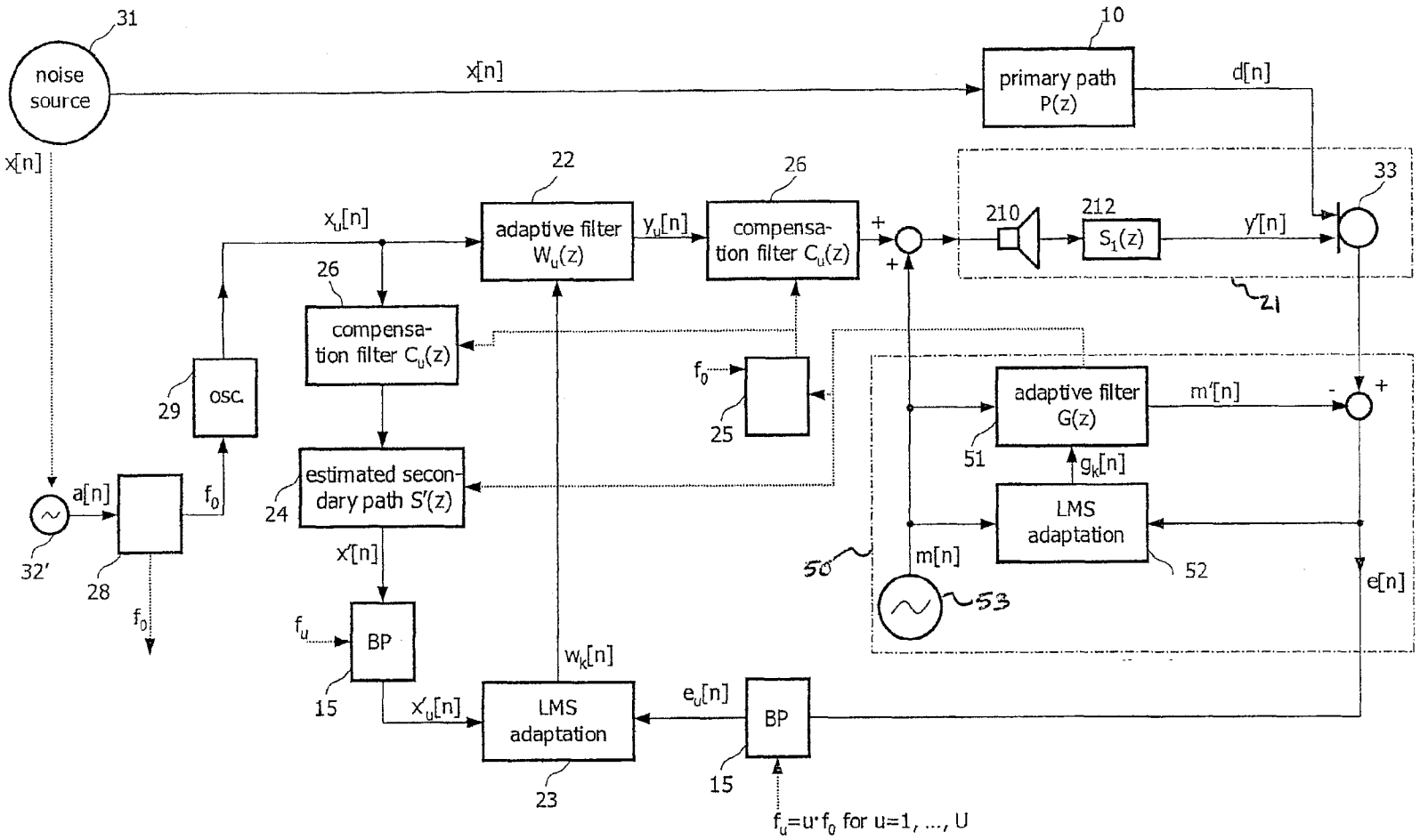
FIG. 12 is a block diagram illustration of an improved narrow band ANC system including secondary path compensation filters.

FIG. 12 is a block diagram illustration of another example of a narrow band ANC system that, for example, only relies on a synthesized reference signal $x_u[n]$ provided by the oscillator 29, where the oscillator 29 provides orthogonal oscillations of the base frequency $f_0$ and higher order harmonics thereof. The index "u" denotes the order of the harmonic oscillation, wherein u=1 denotes the base frequency $f_0$, u=2 the first harmonic with a frequency $f_2=2\cdot f_0$, etc. The base frequency of the oscillator is provided by the base frequency extraction unit 28 which receives a sensor signal a[n] from a non-acoustical sensor (i.e., a rotational speed sensor or a speedometer disposed in a vehicle). The ANC system is, in the present example, only able to compensate for frequency components present in the disturbance signal d[n] that are equal to the base frequency or to the frequency of the corresponding higher-order harmonics.

In the present narrow band version of the ANC system, the implementation of the adaptive filters 22 and the compensation filters 26 is easier and less computational power is required during operation of the system. In contrast to the broad band version (see FIG. 11) of the ANC system where the adaptive filter 22 and the compensation filters 26 are realized, for example, as FIR filters, the narrow band version these filters may efficiently be implemented as complex filters. For example, the reference signal $x_u[n]$ may be denoted as a complex signal:

$$x_u[n]=\Sigma_u\{\cos(2\pi\cdot uf_0\cdot n/f_{SAMP})+j\cdot\sin(2\pi\cdot uf_0\cdot n/f_{SAMP})\},$$

where u=1, . . . , U, and U is the order of the highest harmonic. This signal is provided by the oscillator 29 which generates orthogonal oscillations (i.e., sine and cosine components at the base frequency and each harmonic). The adaptive filter 22 may be characterised by U complex coefficients $W_u$, and the compensation filter 26 may be characterised by U complex coefficients $C_u$. Note that one embodiment of implementing the serial connection of adaptive filter 22 and compensation filter 26 is explained later with reference to FIG. 14.

The complex filter coefficients of the compensation filter are calculated by the coefficient extraction unit 25 from the estimated secondary path transfer function S'(z)=G(z) as follows:

Determine the relevant angular frequencies $\omega_u=2\pi\cdot uf_0$ (for u=1, . . . , U) of the base oscillation and the relevant higher order harmonics;

Determine the corresponding values $S'(\exp(j\omega_u))$ of the estimated secondary path transfer function; and Calculate the complex inverse $C_u=S'(\exp(j\omega_u))$ for u=1, . . . , U, that is, $$Re\{C_u\}=Re\{S'(\exp(j\omega_u))\}/|S'(\exp(j\omega_u))|, \text{ and}$$

$$Im\{C_u\}=-Im\{S'(\exp(j\omega_u))\}/|S'(\exp(j\omega_u))|.$$

The secondary path compensation allows the FXLMS algorithm to converge faster, and thus increase the adaptation speed and the performance of the entire system. That is, the pre-filtering of the effective reference signal $x_e^*[n]$ in the signal path upstream to the LMS adaptation unit may be omitted where an ideal compensation of the secondary path is achieved (i.e., where the condition C(z)S'(z)=1 is true). This is particularly true for narrow band ANC systems using the complex calculation as described above. This is a further improvement of the overall ANC system performance since the inevitable delay due to the pre-filtering is avoided or reduced.

In broad band systems, when using FIR filters, the product C(z)S'(z) may, for example, always include a time delay, since otherwise the compensation filter C(z) would not be causal. However, a flat magnitude response $|C(z)S'(z)\approx 1$ may also have positive effects on the overall performance of the system, especially where the magnitude response of the secondary path includes significant peaks and/or notches.

Optionally, a band-pass filter 15 may be arranged in the signal paths upstream to the LMS adaptation unit 23. The band-pass filter 15 has a number of "U" pass bands with corresponding center frequencies where $f_u=u\cdot f_0$. In the example of FIG. 12, a first band-pass filter 15 receives the error signal e[n] and provides a filtered error signal $e_u[n]$ to the LMS adaptation unit 23. A second band-pass filter 15 receives the filtered effective reference ("filtered-x") signal x'[n] and provides a band-pass filtered signal $x'_u[n]$ to the LMS adaptation unit 23. The center frequencies of the pass-bands are a function of the base frequency $f_0$ provided by the base frequency extractor 28. This band-pass filtering improves robustness and stability of the overall ANC system by suppressing intermodulation products of different harmonics of the base frequency. The band-pass filtering further ensures that the complex sub-filters of the adaptive filter 22, each represented by one complex coefficient $W_u$, operate independently (i.e., one certain frequency component $u\cdot f_0$ of the error signal e[n], for example, only has effect on the corresponding filter coefficient $W_u$).

Figure 13:
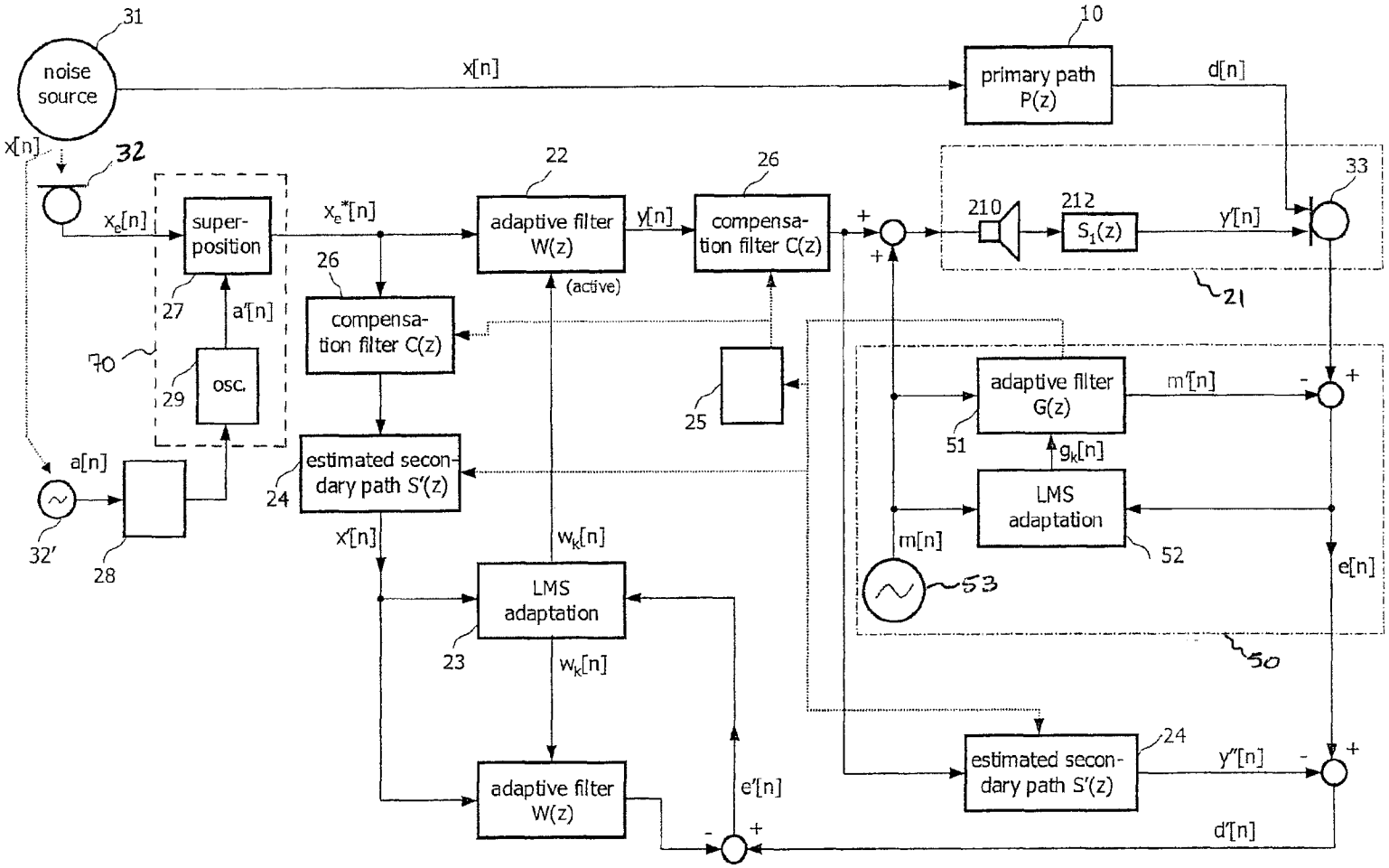
FIG. 13 is a block diagram illustration of an ANC system using a modified FXLMS algorithm.

FIG. 13 is a block diagram illustration of another embodiment of a broad band ANC system that is similar to the embodiment of FIG. 11. However, the modified FXLMS algorithm (MFLMS) is used instead of the basic FXLMS algorithm. The basic principle and structure of the MFXLMS algorithm has already been explained with reference to FIG. 4B. The function of the secondary path compensation filters 26 is similar to that in the embodiment of FIG. 11.

Figure 14:
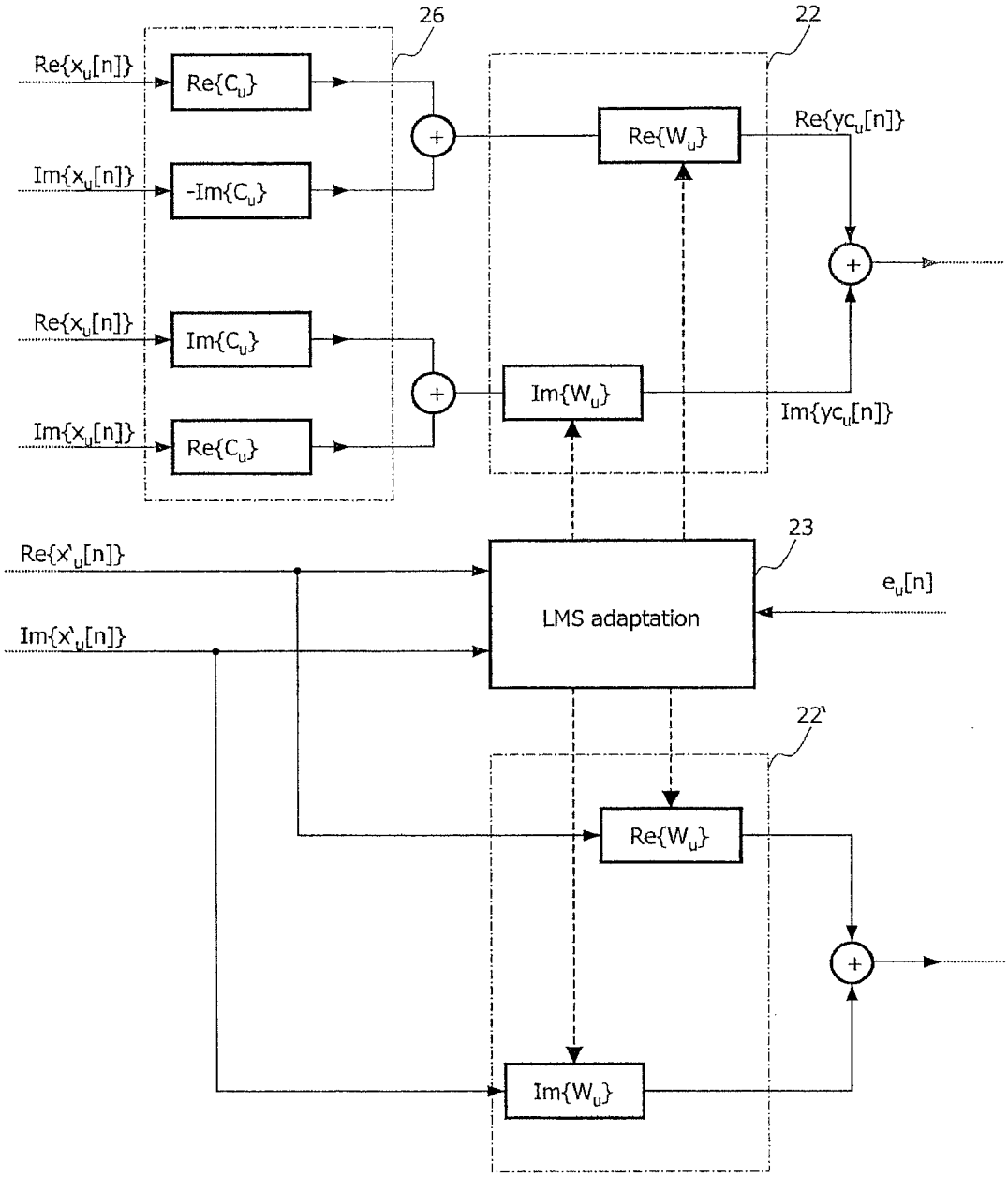
FIG. 14 is a block diagram illustration of the implementation of the complex filters used in the narrow band ANC systems.

FIG. 14 is a block diagram illustration of one embodiment of the adaptive filter 22 and the compensation filter 26 configured in a narrow band ANC system (see FIG. 12) using, however, the MFXLMS instead of the FXLMS algorithm. The compensation filter 26 is depicted to illustrate the signal flow chart of the complex multiplication $x_u[n]C_u$. The result of this multiplication is provided to the active complex adaptive filter 22 (see FIG. 4B). The corresponding shadow filter 22' is supplied with the pre-filtered reference signal $x'_u[n]$ and the LMS adaptation unit 23 adjusts the complex filter coefficients $W_u$ according to the MFXLMS algorithm as set forth above.

FIG. 14 illustrates the compensation filter 26 and the adaptive filters 22, 22' for a considered harmonic of the reference signal $x_u[n]$. The filter structures 22, 22' and 26 are replicated for each additional considered harmonic.

Until now, the ANC systems have been illustrated as single channel systems having one reference signal, one actuator (loudspeaker), and one microphone located in the listening position (i.e., the listening location where noise cancellation is desired). However, the above described innovations for improving robustness by improving stability (see FIGS. 11 to 13) and avoiding instable states of operation (see FIG. 8) may also be applied in multi-channel ANC systems, for example, without significant modifications. Furthermore these innovations may be used in broad band and in narrow band applications.

Figure 15:
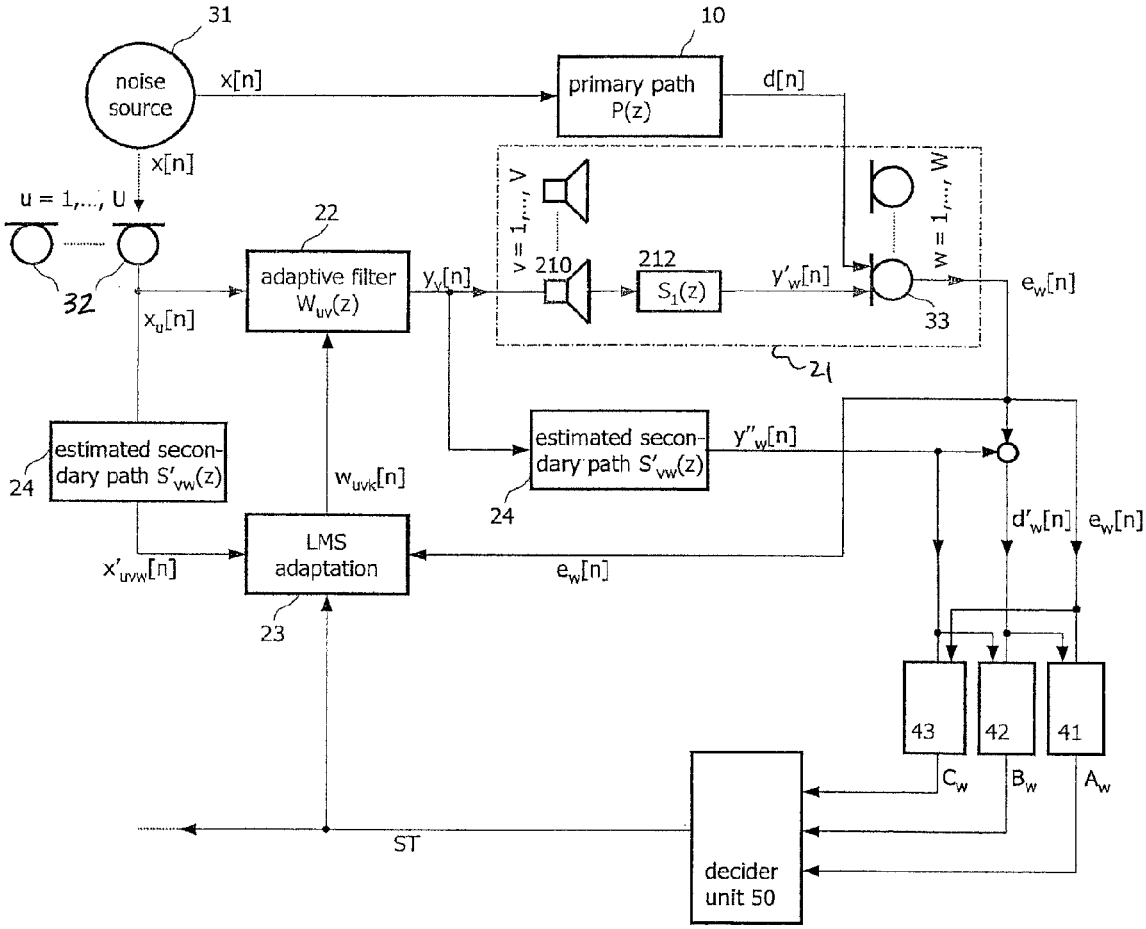
FIG. 15 is a block diagram illustration of a multi-channel embodiment of the ANC system of FIG. 8.

FIG. 15 is a block diagram illustration of an ANC system similar to the system of FIG. 8. The system includes an array of U acoustic sensors 32, an array of V actuators 210 (e.g., loudspeakers), and an array of W microphones located in W different listening positions. The index "u" is the number of the acoustic sensor 32 (e.g., acceleration sensor), the index "v" is the number of the loudspeaker(s), and "w" is the number of the microphone(s) and the listening position(s) respectively. Here the adaptive filter 22 and the secondary path system 21 are MIMO systems (multiple-input/multiple-output systems). In contrast, for a single-channel, these systems are SISO (single-input/single-output) systems (i.e., the adaptive filter $W_{uv}(z)$ may be represented by a matrix of u columns and v lines of transfer function describing the transfer characteristic from each of the U inputs to each of the V outputs). Similarly the secondary path transfer function $S_{vw}(z)$ is a matrix of transfer functions having V columns and W lines. Each sample of reference signal $x_u[n]$ is a vector having U components stemming from the U different sensors 32. Each sample of the compensation signal $y_v[n]$ is a vector having V components wherein each component is supplied to one of the V loudspeakers. Each sample of the residual error signal $e_w[n]$ is a vector having W components stemming from the W different microphones 32.

The LMS adaptation unit is adapted to execute a multi-channel filtered-x-LMS (FXLMS) adaptation algorithm, where the reference signal $x_u[n]$ is pre-filtered with the estimated secondary path transfer function $S'_{vw}(z)$, wherein each of the U vector components of the signal $x_u[n]$ is filtered with each of the V·W transfer functions of $S'_{vw}(z)$ yielding a number of U·V·W filtered-x samples in each of the adaptation steps which are processed by the LMS adaptation unit 23.

When using a narrow band ANC system, the MIMO filtering may be replaced by a complex multiplication for each considered harmonic of the reference signal $x_u[n]$, as already explained with reference to FIG. 12. In the narrow band case, no acoustic sensors are used, but a set of U different harmonics of the reference signal is synthesized. The dynamic secondary path estimation 50 as illustrated in FIGS. 7 and 11-13 may be used in a multi-channels system when employing a multi-channel system identification algorithm.

Although various examples to realize the invention have been disclosed, it will be apparent to those skilled in the art that various changes and modifications may be made which will achieve some of the advantages of the invention without departing from the spirit and scope of the invention. Especially all the embodiments explained by example of a single-channel ANC system may be configured as multi-channel ANC systems. Furthermore it may be useful to combine the stability detection (see FIGS. 8 and 15) and the secondary path equalization (see FIGS. 11-13) for further improvement of the overall performance in terms of speed and stability.

It will be obvious to those reasonably skilled in the art that other components performing the same functions may be suitably substituted. Such modifications to the inventive concept are intended to be covered by the following claims. Furthermore the scope of the invention is not limited to automotive applications, but may also be applied in any other environment (e.g., in consumer applications like home cinema or the like, and also in cinema and concert halls or the like).

What is claimed is:

1. An active noise cancellation system for reducing, at a listening position, power of a noise signal radiated from a noise source to the listening position, the system comprising:

an adaptive filter that receives a reference signal representing the noise signal and provides a compensation signal;

at least one acoustic actuator that receives the compensation signal and radiates an audio compensation signal indicative of the compensation signal to the listening position;

a signal processing device that evaluates and assesses the stability of the adaptive filter;

an LMS adaptation unit to adjust filter characteristics of the adaptive filter using a least mean square algorithm, where the LMS algorithm has a step-size parameter and a leakage parameter;

a microphone disposed at the listening position, where the microphone senses and provides a residual error signal;

a filter connected downstream to the adaptive filter to provide an estimation of the compensation signal at the listening position;

a subtractor that subtracts the estimated compensation signal at the listening position from the error signal and provides an estimated noise signal at the listening position; and a decider unit that receives signals indicative of the error signal, the estimated compensation signal at the listening position, and the estimated noise signal at the listening position and assesses the stability of the adaptive filter and provides a stability signal indicative thereof.

2. The system of claim 1, where the least mean square algorithm is one of a filtered-x-LMS algorithm and a modified filtered-x-LMS algorithm.

3. The system of claim 1, where the decider unit assesses the adaptive filter as stable, and if the ratio between the signal power of the estimated compensation signal at the listening position and the signal power of the estimated noise signal at the listening position is below a given threshold.

4. The system of claim 1, where the decider unit assesses the adaptive filter as stable, and if the ratio between the power of the residual error signal and the power of the estimated noise signal at the listening position is within a given interval.

5. The system of claim 1, where the decider unit deactivates the active noise control system if the adaptive filter is assessed as unstable.

6. The system of claim 5, where the decider unit deactivates the active noise control system where the adaptive filter is assessed as unstable for longer than a pre-defined period.

7. The system of claim 1, where the decider unit modifies at least one of the step size parameter and the leakage parameter where the adaptive filter is assessed as unstable.

8. The system of claim 1, where the decider unit provides a signal indicating whether the adaptive filter is assessed as unstable.

9. The system of claim 1, where the decider unit initiates a re-initialization of the system parameter where the adaptive filter is assessed as unstable.

10. The system of claim 1, where the signal processing device evaluates and assesses the stability of the adaptive filter separately at different frequencies, which different frequencies include a base frequency and higher order harmonics thereof.

11. The system of claim 10, where the adaptive filter multiplies each frequency component of the input signal with a complex filter coefficient.

12. The system of claim 10, further comprising a non-acoustical sensor that provides information about a base frequency of the noise signal; and an oscillator that provides the reference signal;

where the reference signal is composed of harmonic oscillations with the base frequency and higher order harmonics thereof.

13. The system of claim 1, further comprising a secondary path estimation system that estimates a transfer function describing transfer characteristics between the acoustic actuator and the microphone.

14. An active noise cancellation method for reducing, at a listening position, power of a noise signal radiated from a noise source to the listening position, the method comprising:

providing a reference signal correlated with the noise signal;

filtering the reference signal with an adaptive filter to provide a compensation signal;

radiating the compensation signal to the listening position;

sensing a residual error signal at the listening position;

adapting filter coefficients of the adaptive filter as a function of the error signal and the reference signal;

evaluating and assessing the stability of the adaptive filter;

estimating the compensation signal and the noise signal at the listening position, where the evaluating and assessing step comprises determining the power of the estimated compensation signal, the estimated noise signal, and the residual error signal;

calculating stability parameters from the signal power values; and comparing the stability parameters with given threshold values to evaluate stability of the adaptive filter.

15. The method of claim 2, further comprising filtering the compensation signal with a compensation filter before radiating the compensation signal with an acoustic actuator, where the compensation filter includes a transfer characteristic chosen such that the total transfer characteristic characterizing a signal path from the acoustic actuator to the listening position is equalized.

* * * * *

UNITED STATES PATENT AND TRADEMARK OFFICE

CERTIFICATE OF CORRECTION

PATENT NO. : 8,565,443 B2
APPLICATION NO. : 12/483661
DATED : October 22, 2013
INVENTOR(S) : Michael Wurm It is certified that error appears in the above-identified patent and that said Letters Patent is hereby corrected as shown below:

In the Claims

Column 25
Line 3, please delete “claim 2” and insert -- claim 14 --

Signed and Sealed this
Twenty-second Day of April, 2014

Michelle K. Lee

Michelle K. Lee
*Deputy Director of the United States Patent and Trademark Office*